US008577074B2

(12) United States Patent
Babb

(10) Patent No.: US 8,577,074 B2
(45) Date of Patent: Nov. 5, 2013

(54) VORTEX COOLING OF VOICE COILS

(75) Inventor: Alan Babb, Burnsville, MN (US)

(73) Assignee: Robert Bosch GmbH, Stuttgart (DE)

( * ) Notice: Subject to any disclaimer, the term of this patent is extended or adjusted under 35 U.S.C. 154(b) by 514 days.

(21) Appl. No.: 13/026,374

(22) Filed: Feb. 14, 2011

(65) Prior Publication Data

US 2012/0207338 A1 Aug. 16, 2012

(51) Int. Cl.
*H04R 1/00* (2006.01)
*H04R 9/06* (2006.01)
*H04R 11/02* (2006.01)

(52) U.S. Cl.
USPC ..... 381/397; 381/412

(58) Field of Classification Search
USPC ..... 381/397, 412, 414, 419–421
See application file for complete search history.

(56) References Cited

U.S. PATENT DOCUMENTS

| | | | | |
|---|---|---|---|---|
| 2,270,787 | A * | 1/1942 | Schulze et al. | 381/397 |
| 3,963,178 | A | 6/1976 | Collins | |
| 4,757,547 | A | 7/1988 | Danley | |
| 5,042,072 | A | 8/1991 | Button | |
| 5,426,707 | A | 6/1995 | Wijnker | |
| 5,497,428 | A | 3/1996 | Rojas | |
| 5,507,617 | A | 4/1996 | Sun | |
| 5,909,015 | A | 6/1999 | Yamamoto et al. | |
| 6,243,479 | B1 | 6/2001 | Proni | |
| 6,430,300 | B1 | 8/2002 | Cox et al. | |
| 6,535,613 | B1 | 3/2003 | Ssutu | |
| 6,678,387 | B2 | 1/2004 | Kemmerer | |
| 6,771,791 | B2 | 8/2004 | Shelley et al. | |
| 6,868,165 | B1 * | 3/2005 | Fabian | 381/397 |
| 7,831,059 | B1 | 11/2010 | Sahyoun | |
| 2001/0031063 | A1 | 10/2001 | Langford et al. | |
| 2007/0116322 | A1 * | 5/2007 | Horigome et al. | 381/396 |

FOREIGN PATENT DOCUMENTS

| | | |
|---|---|---|
| CN | 201431412 Y | 5/2009 |
| JP | 04363999 | 12/1992 |
| JP | 2007104626 A | 4/2007 |

* cited by examiner

*Primary Examiner* — Jesse Elbin
(74) *Attorney, Agent, or Firm* — Keith Swedo, Esq.; Taft Stettinius & Hollister LLP

(57) ABSTRACT

A low frequency transducer arrangement includes at least one substantially annular magnet. A voice coil is disposed within and concentric with the magnet. A pole is disposed within and concentric with the voice coil. An air gap is defined between the magnet and the pole. The pole includes a bottom half having a downwardly facing axial recess. A plurality of first air passages extend laterally from the axial recess and fluidly interconnect the recess and the air gap. A top half has an upwardly facing axial recess. A plurality of second air passages extend laterally from the upwardly facing axial recess and fluidly interconnect the upwardly facing recess and the air gap. The first air passages and/or the second air passages are non-radially oriented.

19 Claims, 25 Drawing Sheets

VORTEX COOLING OF VOICE COILS

BACKGROUND OF THE INVENTION

1. Field of the Invention

The present invention relates to high power low frequency transducers, and, more particularly, to high power low frequency transducers having a magnetic structure with an air gap and a voice coil located in the air gap.

2. Description of the Related Art

A high power low frequency transducer, commonly referred to as a "loudspeaker," has a magnetic structure with "air gaps" and voice coils that are located in the air gap(s). At normal operating sound pressure levels, it is common for the voice coil temperature to reach 280° C. (536° F.). This high temperature has the deleterious effect of reducing the transducer's efficiency and reliability. Known techniques for reducing the voice coil temperature include using air circulation to cool the voice coil, but these known techniques have not provided sufficient air flow in terms of volume and velocity in order to be effective.

What is neither disclosed nor suggested by the prior art is a high power low frequency transducer in which the operating temperature of the voice coil is effectively limited to thereby preserve the voice coil's efficiency and reliability.

SUMMARY OF THE INVENTION

The present invention provides a high power low frequency transducer having a magnetic structure with an air gap and a voice coil located in the air gap. Two separate air intakes route cooling air through spiral (e.g., non-radial) passages that circulate the air around the voice coil and then vent the air through a common exit. When the coil is moving up towards the cone, air enters in through a central bottom opening. A bottom half of a pole directs the incoming air laterally outward. This laterally outwardly directed air, as well as air that is downwardly directed past the coil, are laterally inwardly directed by a top half of the pole. Finally, the air is exhausted through a central upper opening of the pole top half. When the coil is moving downward away from the cone, air flows in directions opposite to that described above.

In a specific embodiment, the air is laterally directed through non-rotating, non-radial air passages of constant cross-sectional area. The non-radial air passages in the pole top half and the pole bottom half may be arranged such that they conjointly define spiraling air passages through the pole.

The invention comprises, in one form thereof, a low frequency transducer arrangement including at least one substantially annular magnet. A voice coil is disposed within and concentric with the magnet. A pole is disposed within and concentric with the voice coil. An air gap is defined between the magnet and the pole. The pole includes a bottom half having a downwardly facing axial recess. A plurality of first air passages extend laterally from the axial recess and fluidly interconnect the recess and the air gap. A top half has an upwardly facing axial recess. A plurality of second air passages extend laterally from the upwardly facing axial recess and fluidly interconnect the upwardly facing recess and the air gap. The first air passages and/or the second air passages are non-radially oriented.

The invention comprises, in another form thereof, a low frequency transducer arrangement including an annular magnet. A voice coil is disposed within and concentric with the magnet. A pole is disposed within and concentric with the voice coil. A cylindrical air gap is defined between the magnet and the pole. The pole is at a substantially same vertical level as the magnet. The pole includes an upwardly facing axial recess. A plurality of first air passages extend laterally from the upwardly facing axial recess and fluidly interconnect the upwardly facing recess and the air gap. An annular steel ring is disposed below and concentric with the magnet. The annular steel ring at least partially defines an outer boundary of the air gap. The steel ring includes a plurality of second air passages extending laterally from the air gap and fluidly interconnecting the air gap and ambient air.

The invention comprises, in yet another form thereof, a low frequency transducer arrangement including two substantially annular and concentric magnets. A voice coil is disposed within and is concentric with at least an upper one of the magnets. A pole is disposed within and is concentric with the voice coil. An air gap is defined between the magnets and the pole. The pole includes a bottom half having a downwardly facing axial recess. A plurality of first air passages extend laterally from the axial recess and fluidly interconnect the recess and the air gap. The bottom half is at a substantially same vertical level as a lower one of the magnets. The pole includes a top half having an upwardly facing axial recess. A plurality of second air passages extend laterally from the upwardly facing axial recess and fluidly interconnect the upwardly facing recess and the air gap. The first air passages and/or the second air passages are non-radially oriented. The top half is at a substantially same vertical level as the upper one of the magnets.

An advantage of the present invention is that the pole piece and the passages therein provide both superior air flow to cool the voice coil and superior magnetic conductance for the magnet.

Another advantage of the present invention is that the non-radial and/or arcuate air passages provide a spiraling air path through the speaker, which results in faster air flow with greater volume, and thereby improved cooling of the former and/or voice coil.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
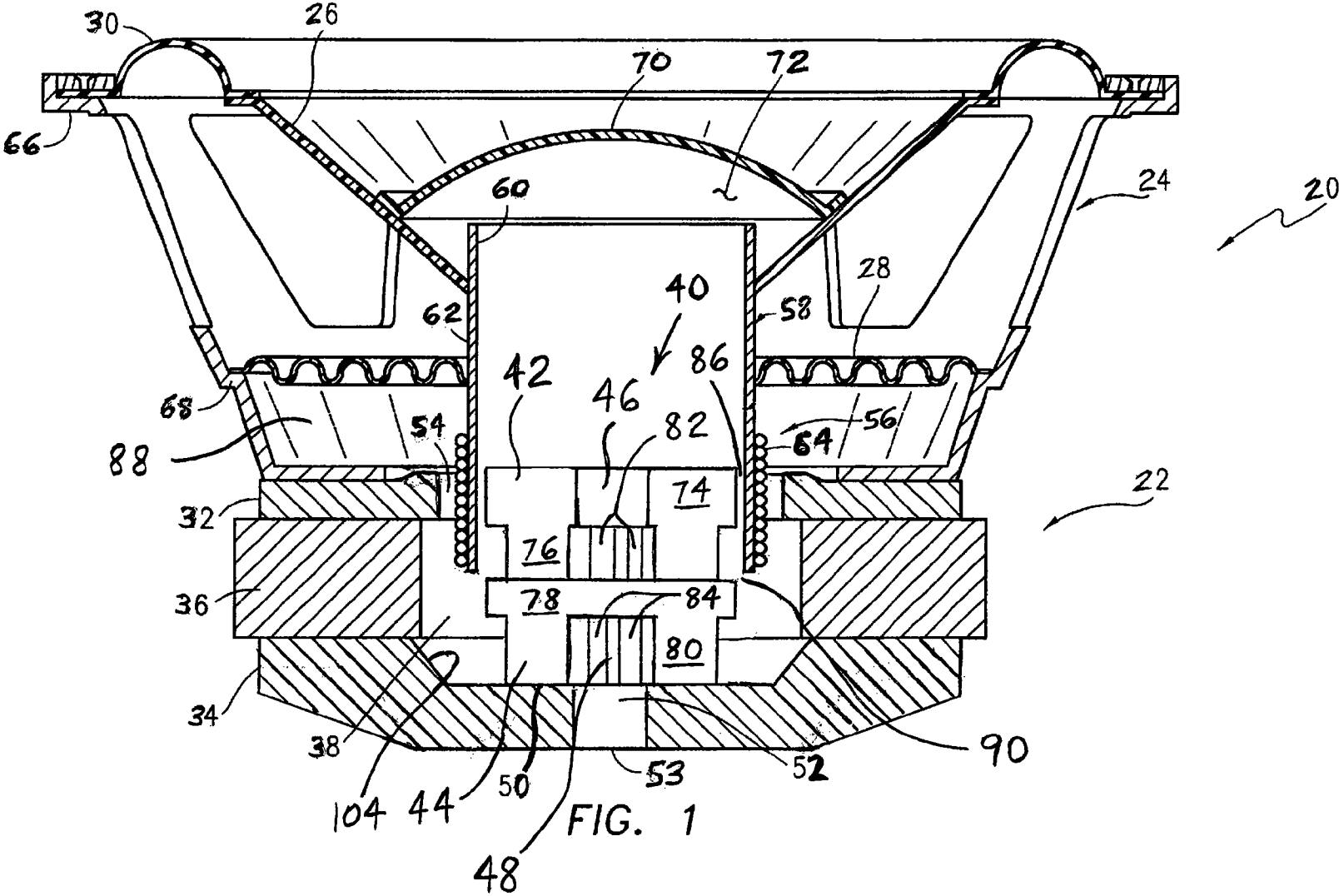
FIG. 1 is a cross-sectional view of one embodiment of a loudspeaker of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings, and particularly to FIG. 1, there is shown one embodiment of a loudspeaker 20 of the present invention including a motor assembly 22, a frame 24 mounted to motor assembly 22, a diaphragm 26, a lower suspension or spider 28 and an upper suspension or surround 30. Motor assembly 22 includes a front plate 32 and a back plate 34 which are spaced from one another and mount or sandwich a permanent magnet 36 therebetween. A pole piece 40 is mounted atop back plate 34 within a central bore 38 formed in both magnet 36 and front plate 32. Pole piece 40 includes a top half 42 and a bottom half 44. Top half 42 includes a throughbore 46. Bottom half 44 includes a bore 48 that is in communication with a bottom surface 50 of bottom half 44, and that extends only partially through the height of bottom half 44. Bore 48 is aligned and in communication with a throughbore 52 extending through back plate 34. Throughbore 52 terminates with a port 53 which is open to atmosphere at back plate 34.

An air gap 54 is defined between front plate 22 and pole piece 40. A voice coil 56 is also provided which includes a hollow, cylindrical-shaped former 58, having an inner surface 60 and an outer surface 62 which receives a wire winding 64. Former 58 is concentrically disposed about pole piece 40, and the voice coil 56 is axially movable within air gap 54 during operation of speaker 20.

Voice coil 56 is held in place with respect to pole piece 40 by diaphragm 26, spider 28 and surround 30. One end of diaphragm 26 is affixed to former 58 by adhesive or the like, and the opposite end of diaphragm 26 connects to surround 30. Surround 30, in turn, is mounted to an upper end 66 of frame 24. Diaphragm 26 and surround 30 collectively provide support for voice coil 56, in addition to the lower suspension or spider 28. An inner annular edge of spider 28 connects to former 58, and an outer annular edge of spider 28 mounts to a seat 68 formed in frame 24.

A dust cap 70 is mounted to the diaphragm 26 in position to overlie the voice coil 56 and pole piece 40 in order to protect such elements from dirt, dust and other contaminants. A dust cap cavity 72 is thus defined in the space surrounded by the lower portion of diaphragm 26, dust cap 70, voice coil 56 and pole piece 40. In response to the input of electrical energy to wire winding 64, voice coil 56 is moved axially with respect to the fixed motor assembly 22. Because diaphragm 26, spider 28, surround 30 and dust cap 70 are operatively connected to former 58, these components also move axially along with voice coil 56. As a result of axial movement of diaphragm 26 and dust cap 70, air flows from outside of speaker 20 and into and out of cavity 72. That is, air is pumped into and out of cavity 72.

Pole piece 40 has an exterior surface that is both stepped and annular. In the specific embodiment shown in FIG. 1, top half 42 includes a larger diameter upper section 74 and a smaller diameter lower section 76. Bottom half 44 similarly includes a larger diameter upper section 78 and a smaller diameter lower section 80. The diameters of upper sections 74, 78 are approximately equal, and the diameters of lower sections 76, 80 are also approximately equal.

As described in more detail hereinbelow, a plurality of circumferentially spaced air passages 82 extend from the lower portion of throughbore 46 to the outer surface of lower section 76. Air passages 82 may be rectangular in cross section. Similarly, a plurality of circumferentially spaced air passages 84 extend from bore 48 to the outer surface of lower section 80. Air passages 84 may also be rectangular in cross section. A gap 86 is defined between upper section 74 and former 58.

Figure 2:
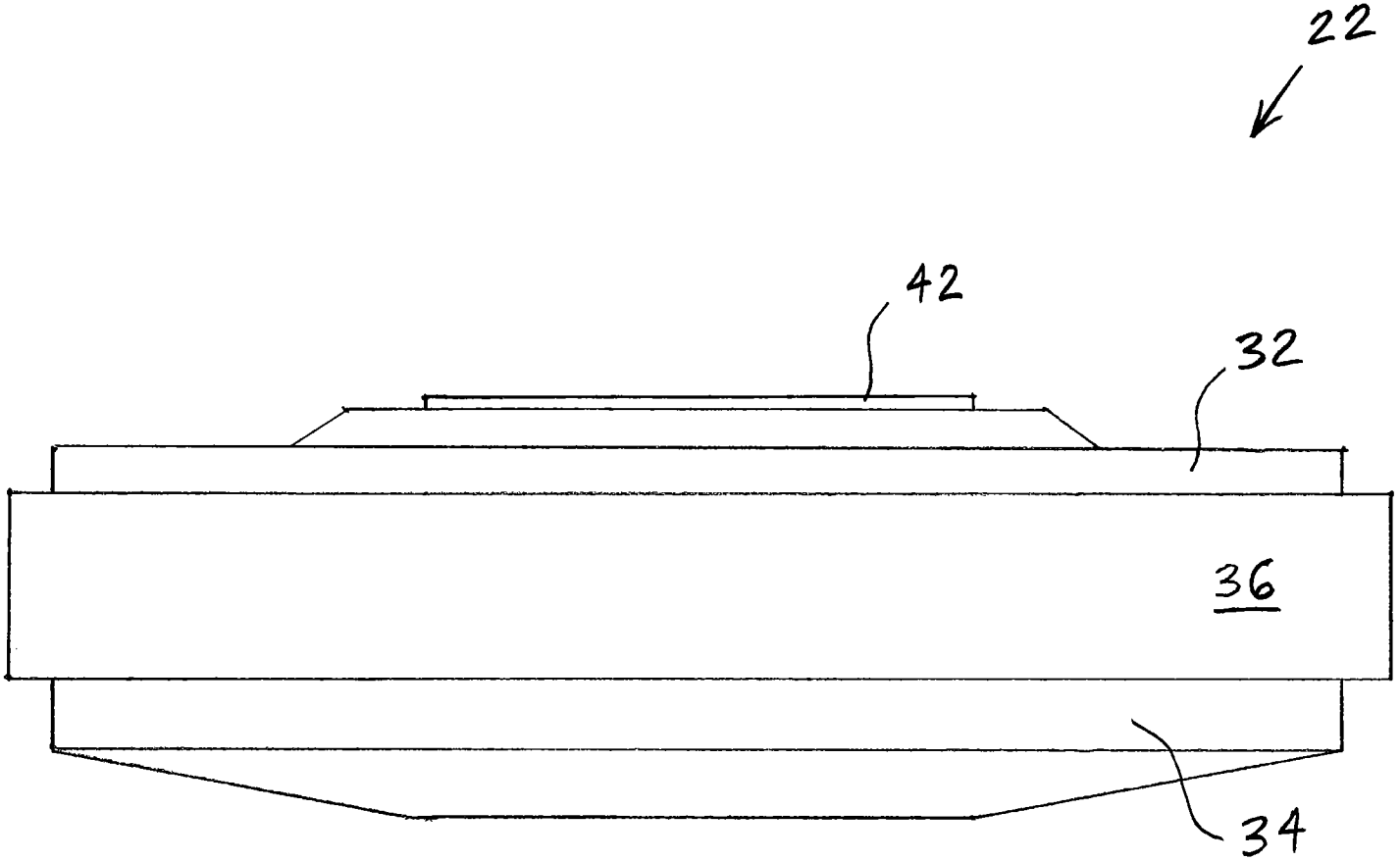
FIG. 2 is a side view of the motor assembly of FIG. 1.
Figure 3:
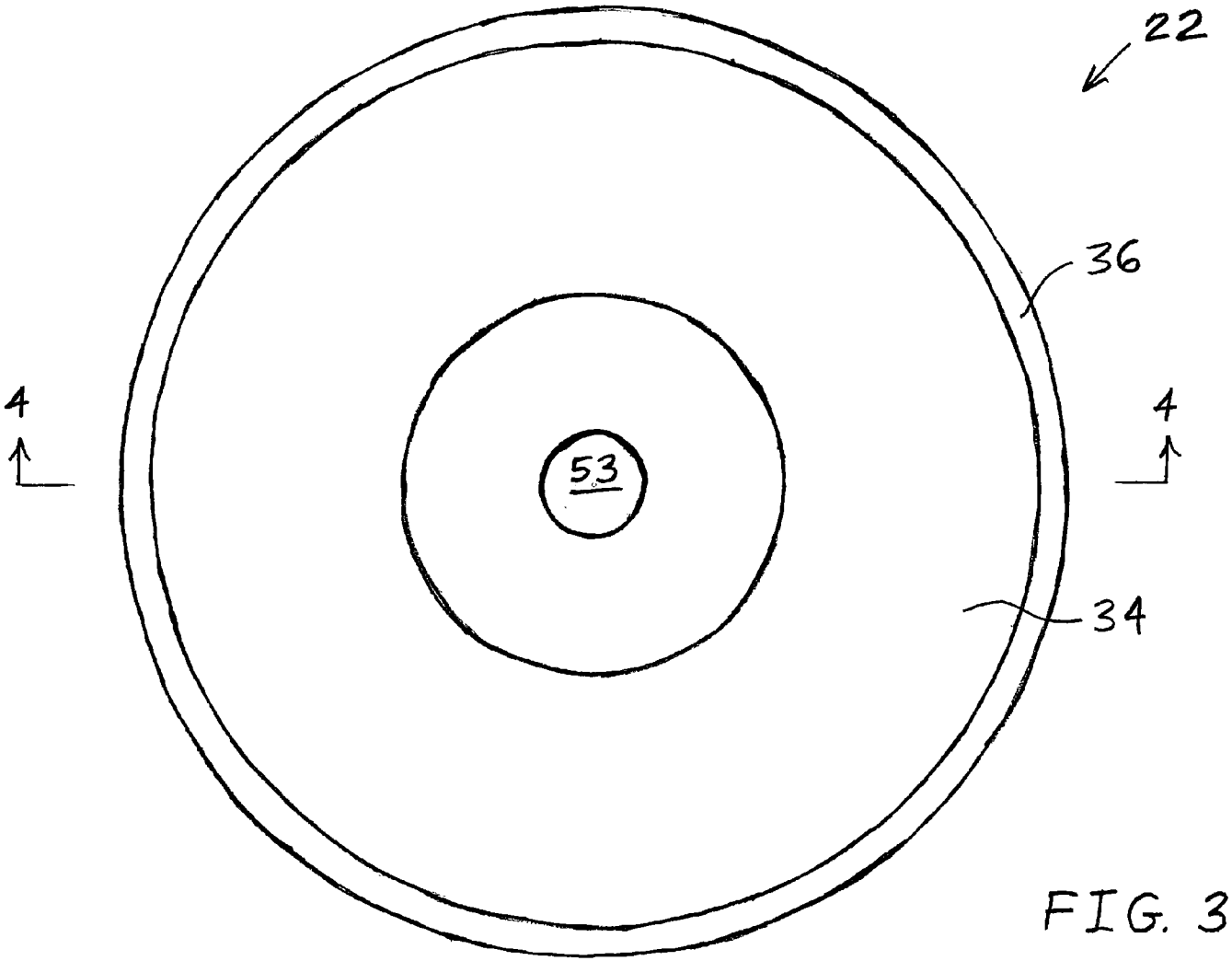
FIG. 3 is a bottom view of the motor assembly of FIG. 2.

Motor assembly 22 is shown in side view in FIG. 2, and in bottom view in FIG. 3. Motor assembly 22 is further shown in isolation in the cross-sectional view of FIG. 4.

Figure 5:
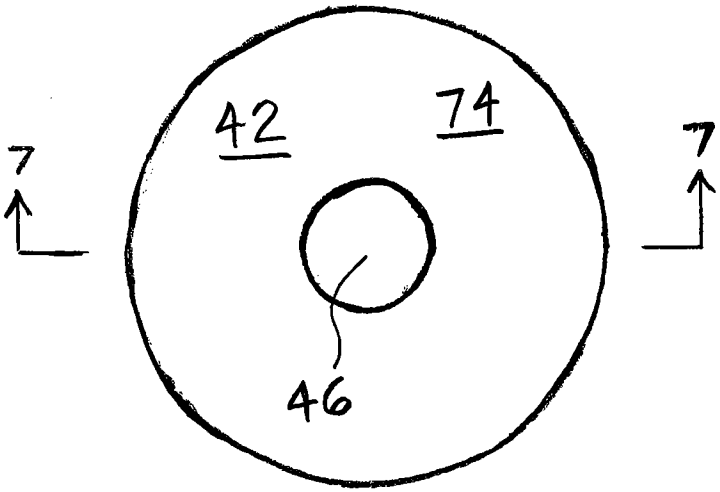
FIG. 5 is a top view of the pole top half of the motor assembly of FIG. 4.
Figure 6:
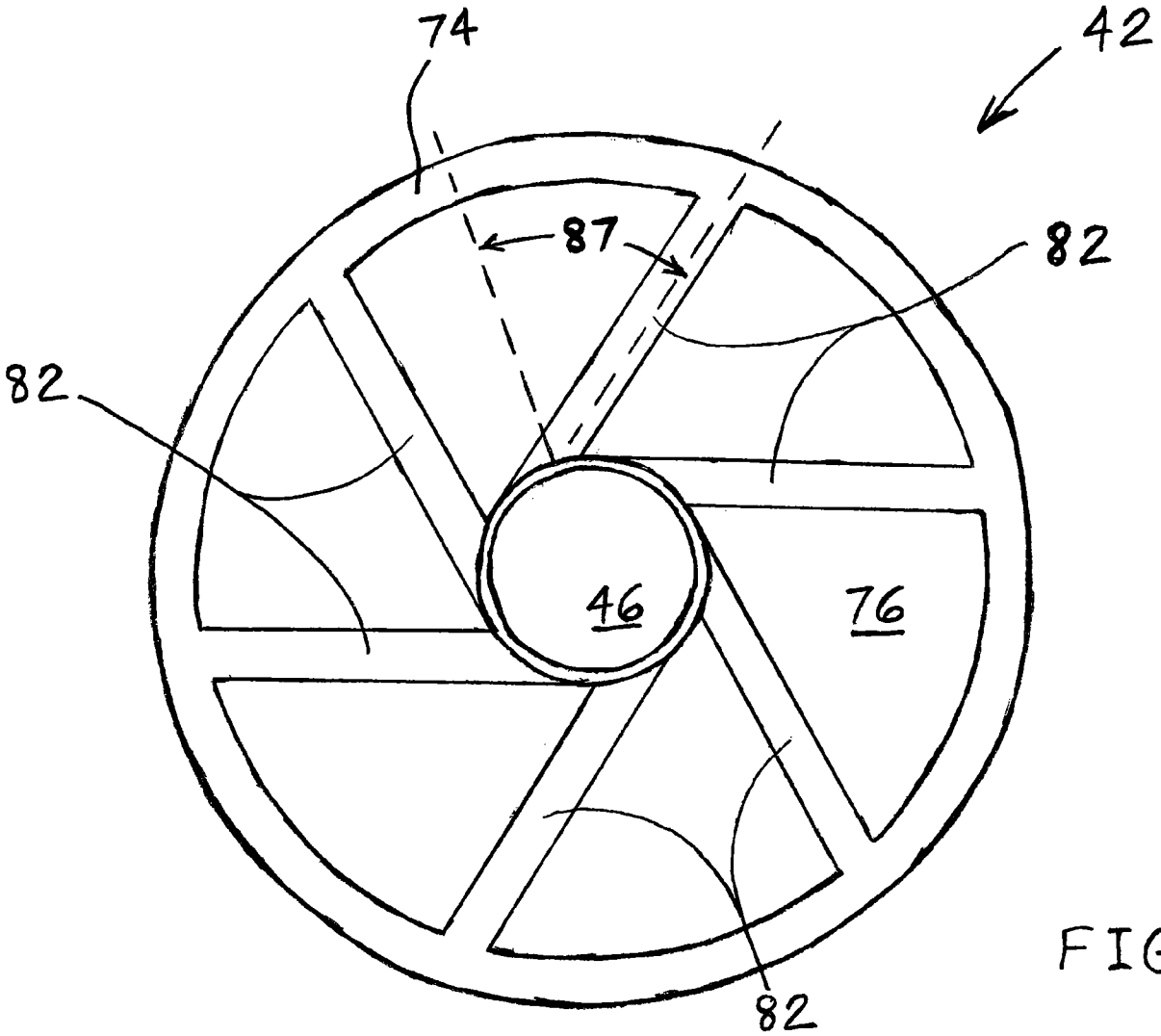
FIG. 6 is a bottom view of the pole top half of the motor assembly of FIG. 4.

Pole top half 42 is shown in isolation in the top view of FIG. 5. As shown in FIG. 6, pole top half 42 includes six evenly spaced air passages 82 in one embodiment. As is also evident from FIG. 6, air passages 82 do not extend in radial directions from throughbore 46. Rather, each of air passages 82 is offset from a corresponding radial direction by an angle 87 of approximately 45 degrees. In one embodiment, angle 87 may range approximately between 30 and 60 degrees. Each of air passages 82 is offset in a same rotational direction (i.e. clockwise or counterclockwise from its corresponding radial direction).

As shown in FIG. 6, each of air passages 82 may have an equal and constant width from throughbore 46 to the outer surface of lower section 76. Further, each of air passages 82 may have a constant height from throughbore 46 to the outer surface of lower section 76, and thus each of air passages 82 may have a constant cross-sectional area from throughbore 46 to the outer surface of lower section 76.

Figure 7:
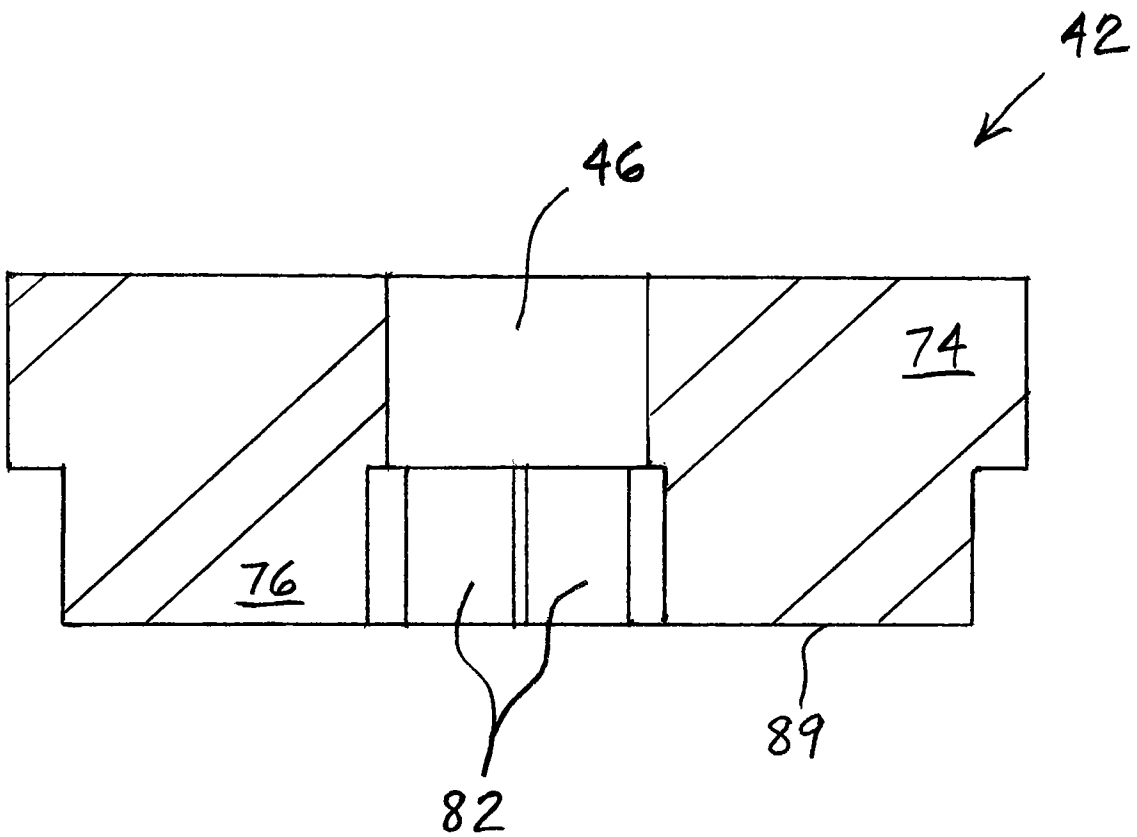
FIG. 7 is a cross-sectional view of the pole top half of FIG. 5 along line 7-7.

As best shown in FIG. 7, top pole half 42 includes a flat bottom surface 89 for interfacing with a flat top surface 91 (FIG. 10) of bottom pole half 44. Bottom surface 89 may be fixedly attached to top surface 91, such as by adhesive.

Figure 8:
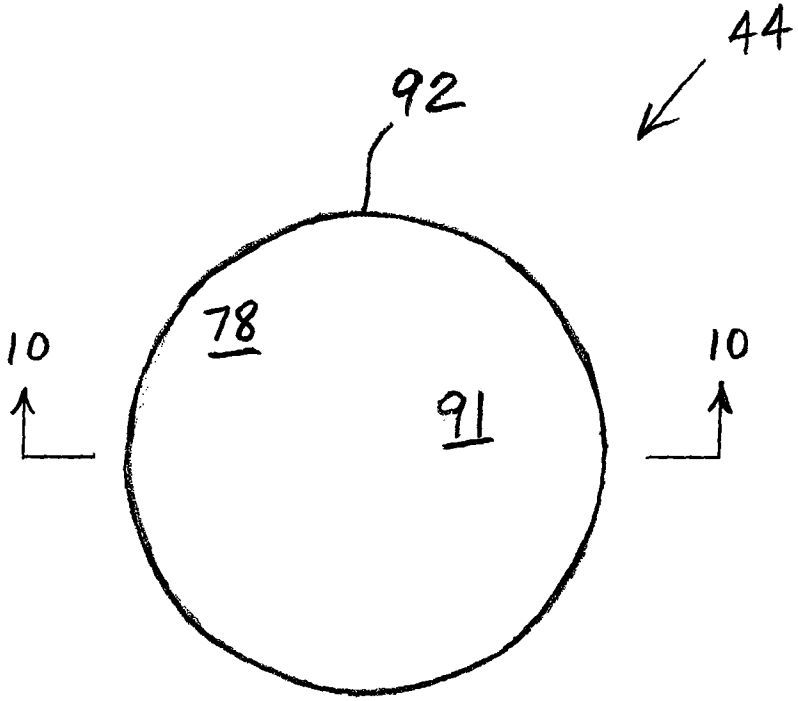
FIG. 8 is a top view of the pole bottom half of the motor assembly of FIG. 4.

As shown in FIG. 8, upper surface 91 of bottom pole half 44 is circular. Further, a circumferential outer surface 92 of upper section 78 is annular. Similarly, an outer surface of upper section 74 of top pole half 42 is annular.

Figure 9:
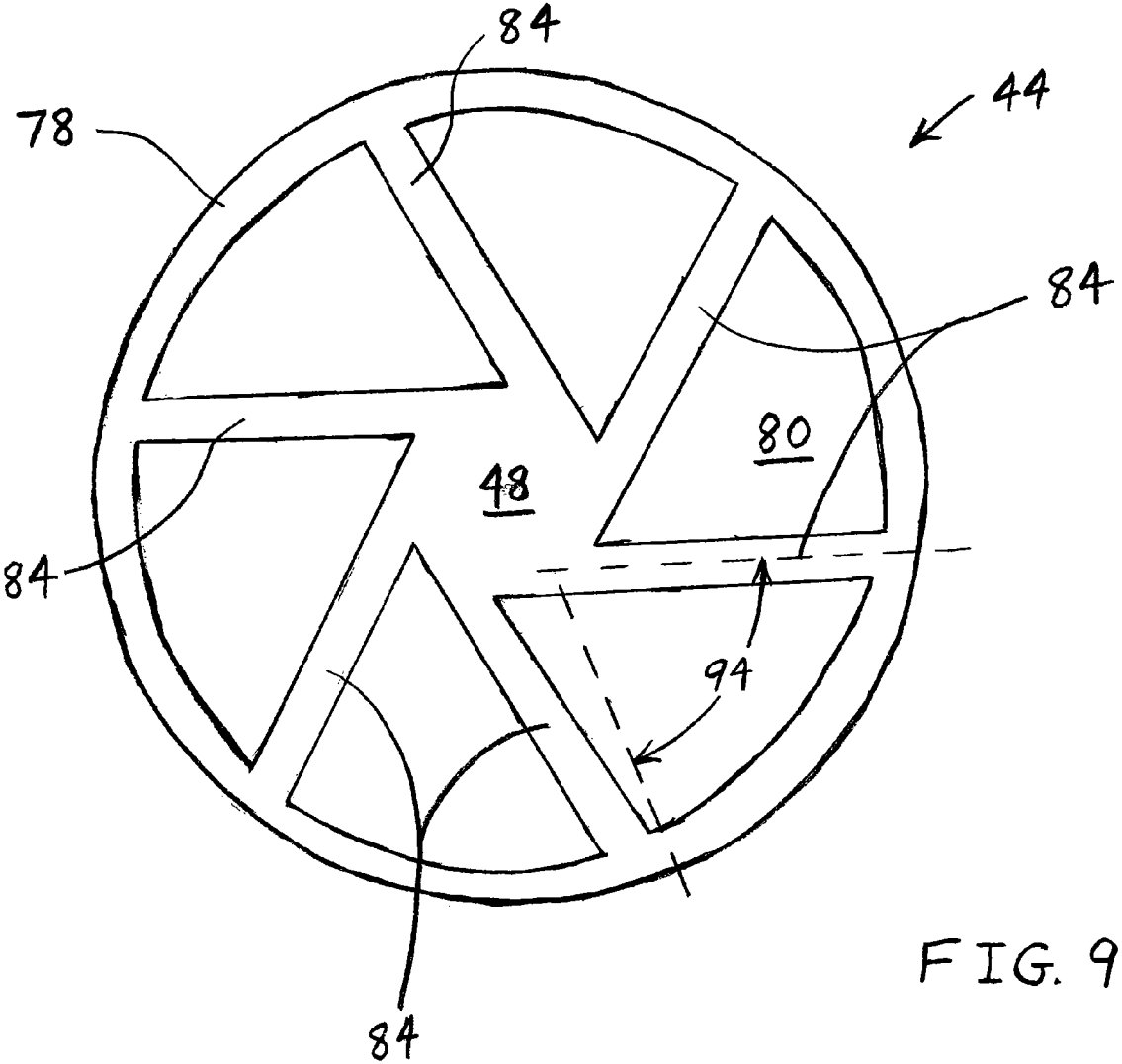
FIG. 9 is a bottom view of the pole bottom half of the motor assembly of FIG. 4.

As shown in FIG. 9, pole bottom half 44 includes six evenly spaced air passages 84 in one embodiment. As is also evident from FIG. 9, air passages 84 do not extend in radial directions from bore 48. Rather, each of air passages 84 is offset from a corresponding radial direction by an angle 94 of approximately 45 degrees. In one embodiment, angle 94 may range approximately between 30 and 60 degrees. Each of air passages 84 is offset in a same rotational direction (i.e. clockwise or counterclockwise from its corresponding radial direction).

As shown in FIG. 9, each of air passages 84 may have an equal and constant width from bore 48 to the outer surface of lower section 80 of pole bottom half 44. Further, each of air passages 84 may have a constant height from bore 48 to the outer surface of lower section 80, and thus each of air passages 84 may have a constant cross-sectional area from bore 48 to the outer surface of lower section 80. Each of air passages 84 is oriented tangentially relative to downwardly facing axial recess 48. Similarly, as shown in FIG. 6, each of air passages 82 is oriented tangentially relative to upwardly facing axial recess 46. That is, each of air passages 84 approximately defines a tangent line to a circumference defined by downwardly facing axial recess 48, and each of air passages 82 approximately defines a tangent line to a circumference defined by upwardly facing axial recess 46.

Figure 10:
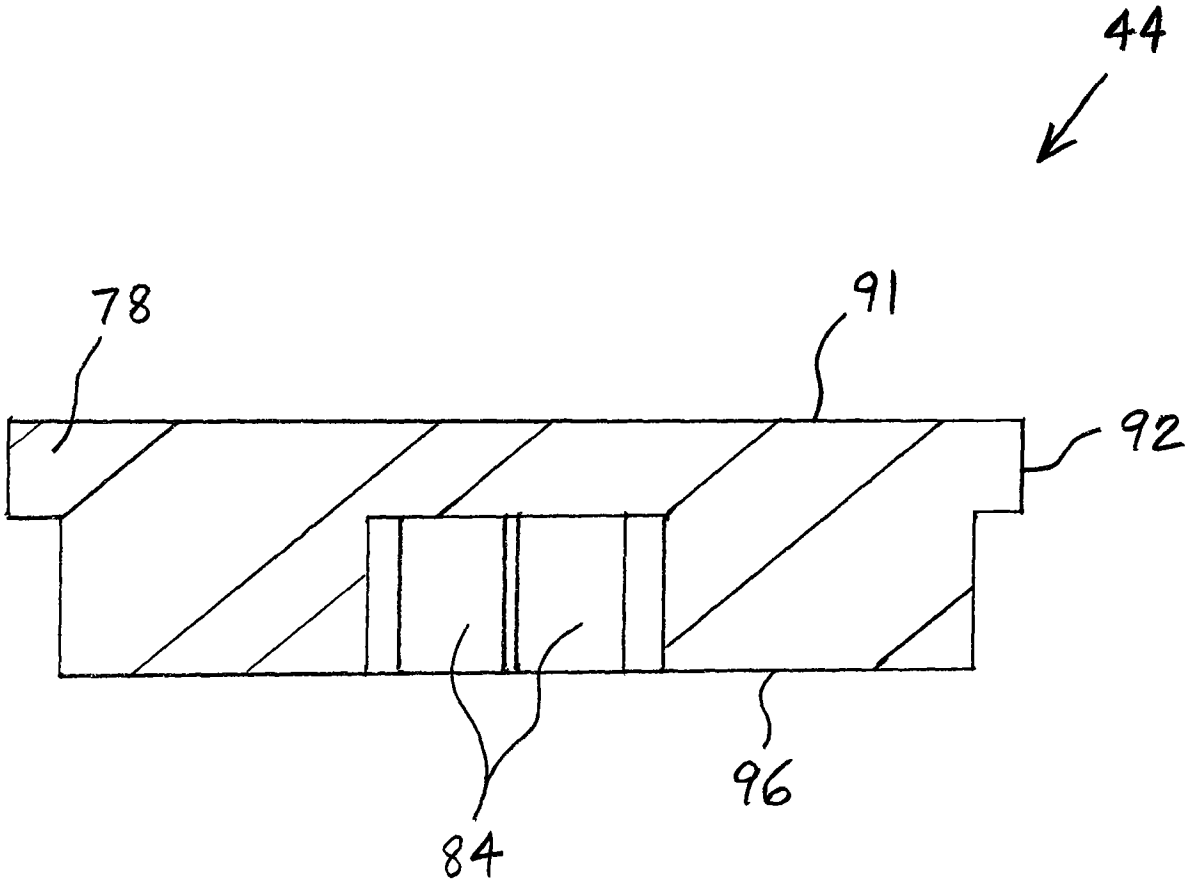
FIG. 10 is a cross-sectional view of the pole bottom half of FIG. 8 along line 10-10.
Figure 12:
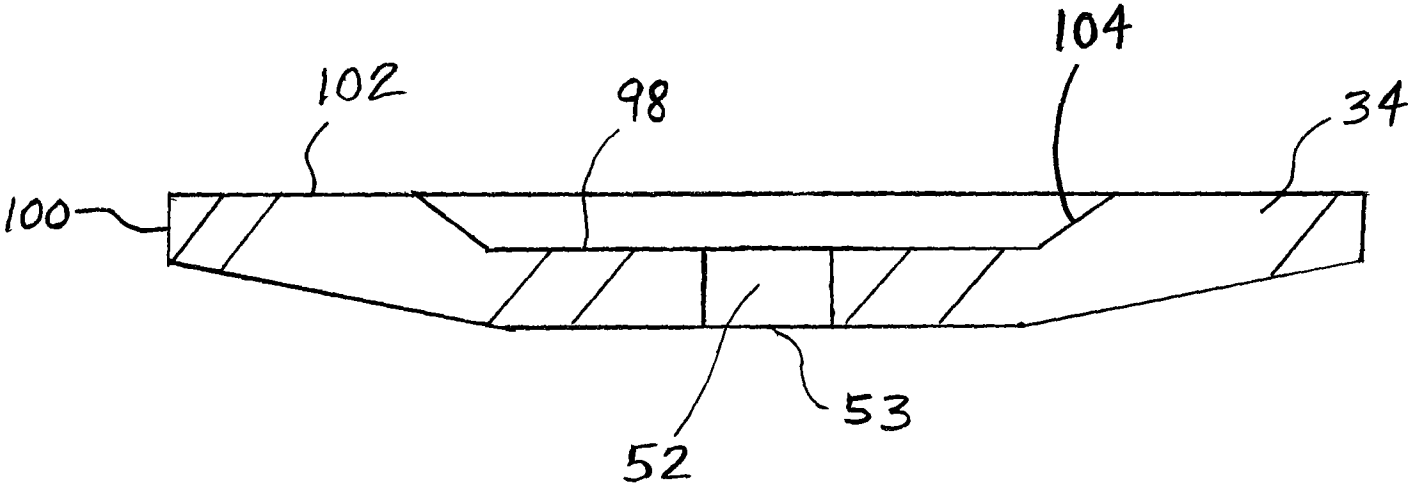
FIG. 12 is a cross-sectional view of the back plate of FIG. 11 along line 12-12.

As best shown in FIG. 10, bottom pole half 44 includes a flat bottom surface 96 for interfacing with a flat annular surface 98 (FIG. 12) of back plate 34. Bottom surface 96 may be fixedly attached to surface 98, such as by adhesive.

Figure 11:
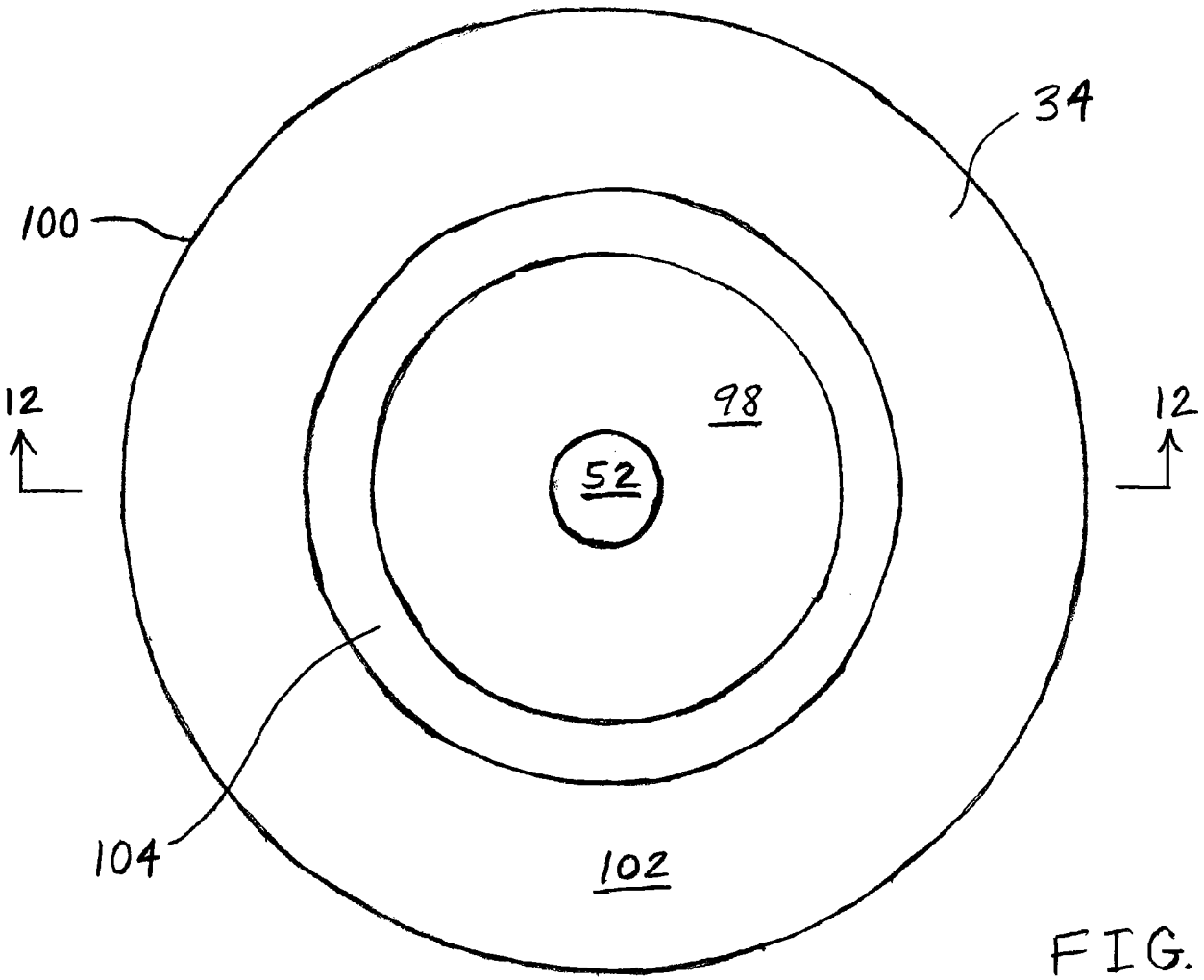
FIG. 11 is a top view of the back plate of the motor assembly of FIG. 4.

As shown in FIG. 11, back plate 34 has an overall circular shape with an annular outer circumferential surface 100. Back plate 34 includes a flat, annular top surface 102 that is parallel to surface 98. An annular ramped surface 104 interconnects top surface 102 with surface 98. Top surface 102 may interface with a flat, annular bottom surface 106 (FIG. 4) of magnet 36. Top surface 102 may be fixedly attached to bottom surface 106, such as by adhesive. As shown in FIG. 1, ramped surface 104 may be disposed at a same vertical level as air passages 84, and thus ramped surface 104 may guide in an upward direction the air flowing out of air passages 84.

Figure 13:
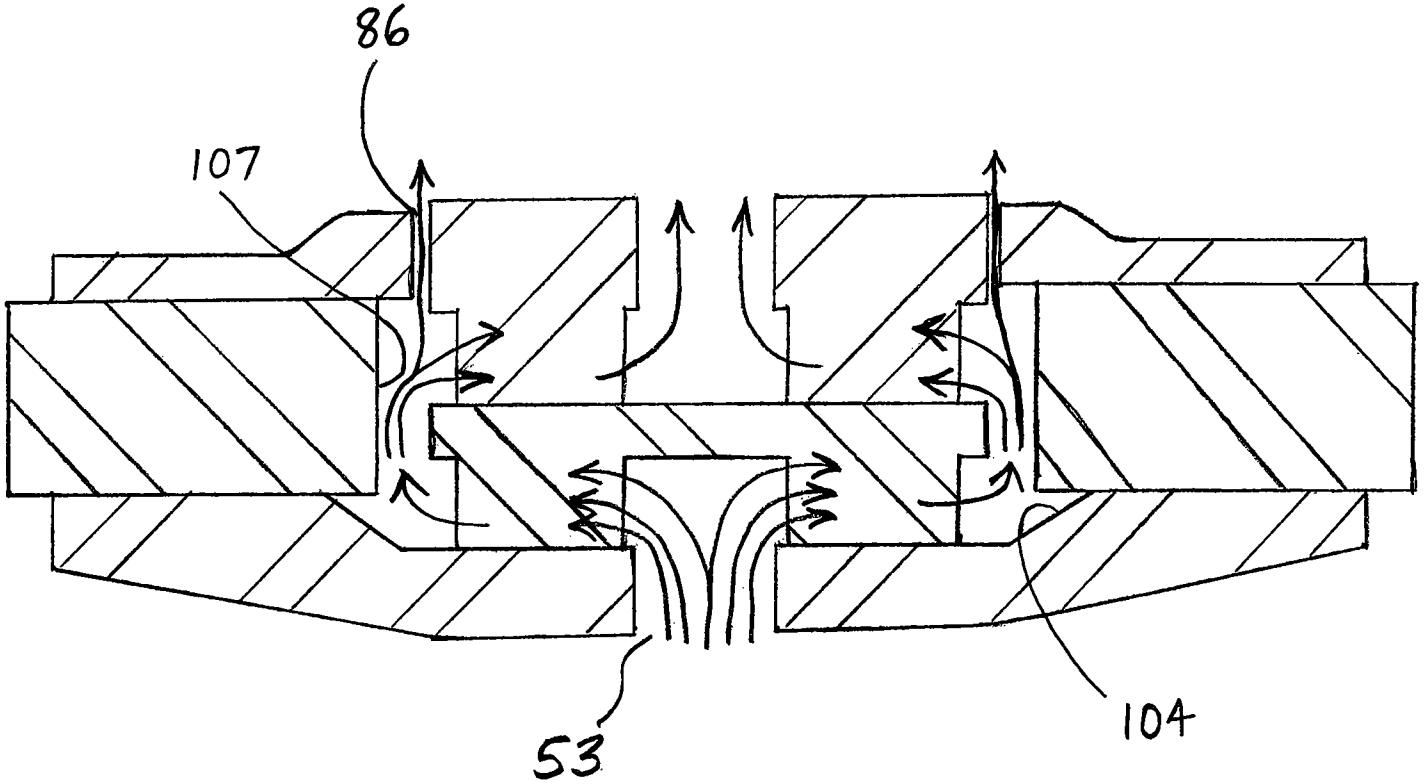
FIG. 13 is a cross-sectional view of the motor assembly of FIG. 3 along line 4-4 illustrating the air flow through the motor assembly when the coil of the loudspeaker is moving up towards the cone.
Figure 14:
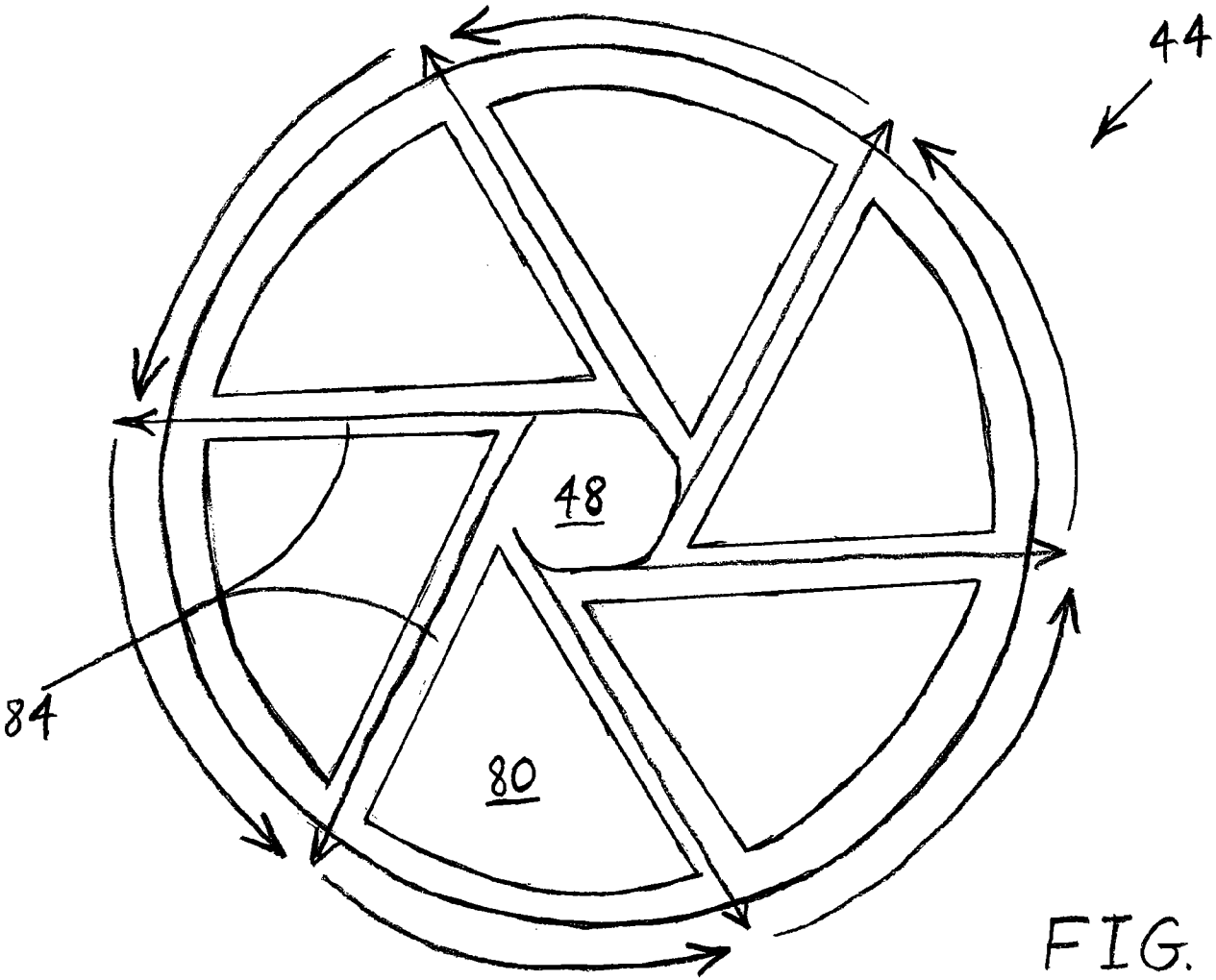
FIG. 14 is a top view of the pole bottom half of the motor assembly of FIG. 4 further illustrating the air flow of FIG. 13.

Illustrated in FIGS. 13-15 are the air flow velocity vectors when voice coil 56 is moving in an upward direction. Specifically, air is drawn vertically upward through bore 48 of bottom pole half 44, and laterally outward through air passages 84 into central bore 38. The air is then drawn laterally inward through air passages 82 of top pole half 42, into throughbore 46, and finally into cavity 72.

Air is drawn upward through throughbore 52 and into bore 48 in a direction into the page of FIG. 14. The slanted orientations of air passages 84 cause the air to be predisposed to flow in the counterclockwise direction shown in FIG. 14 upon existing air passage 84, but with an upward bias as accommodated by the relatively large height of passages 84 as compared to their widths. As can be seen in FIG. 13, the air may be further guided in the counterclockwise direction by annular ramp 104 and an inner annular surface 107 of magnet 36. Because ramp 104 is generally upwardly facing as well as generally radially inwardly facing, ramp 104 also serves to direct or guide the air in an upward direction through central bore 38. Thus, the air may flow upward to the same vertical position as air passages 82 of top pole half 42, where the air continues to swirl in the counterclockwise direction around top pole half 42, as shown in FIG. 15. From this vertical position adjacent to air passages 82, the air may be drawn laterally inwardly through air passages 82. Upon reaching the inner ends of passages 82, the air may be further drawn vertically upward through throughbore 46 and into cavity 72. Alternatively, some smaller fraction of the air may bypass air passages 82 and throughbore 46 and enter cavity 72 via the gap 86 between upper portion 74 of top pole half 42 and inner surface 60 of former 58.

Figure 15A:
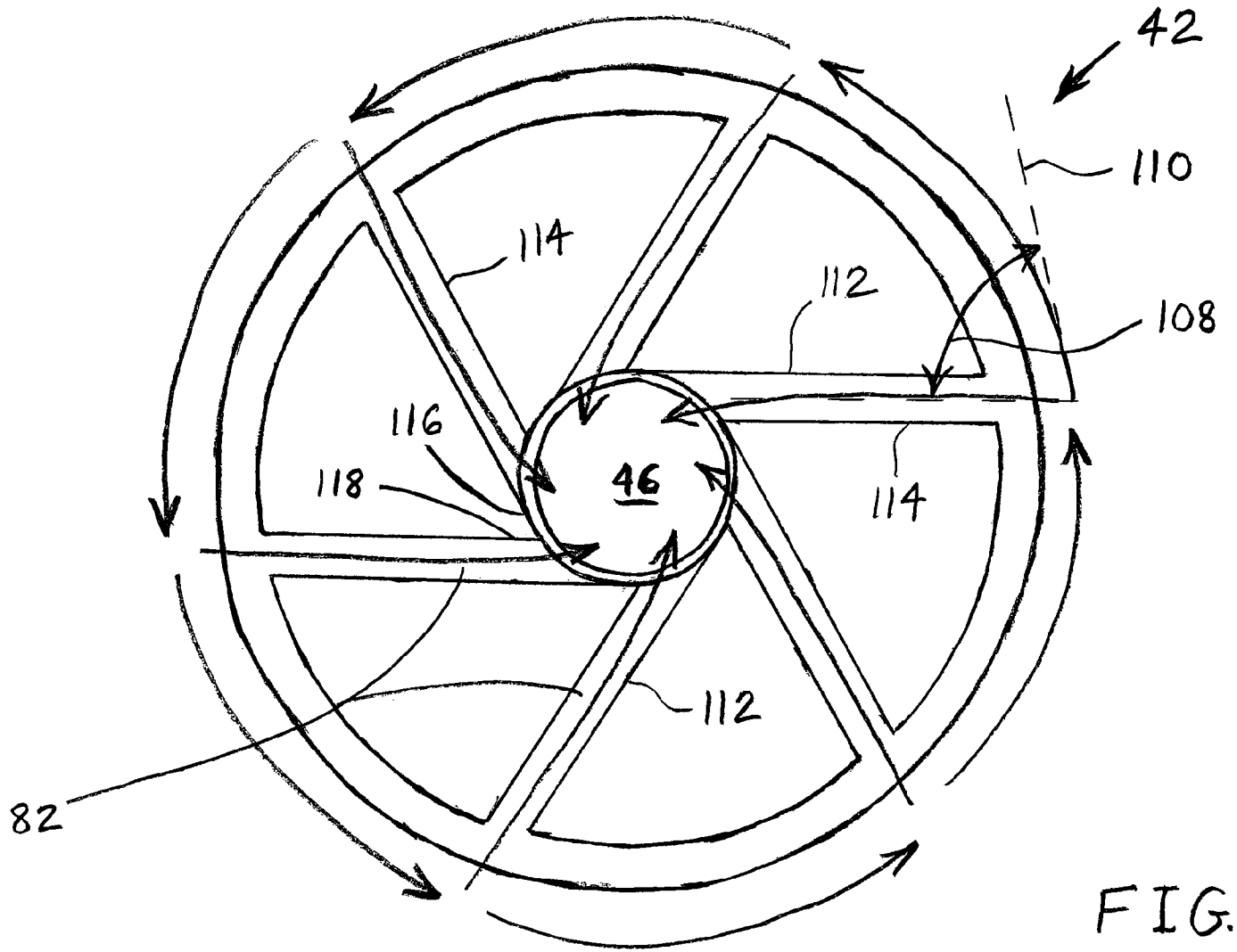
FIG. 15*a* is a top view of the pole top half of the motor assembly of FIG. 4 further illustrating the air flow of FIG. 13.

As shown in FIG. 15*a*, the slanted orientations of air passages 82 of pole top half 42 enables the swirling air around pole top half 42 to be more easily drawn into passages 82. That is, the swirling air does not have to take a sharp right angle turn in a radially inward direction in order to enter air passages 82 (as would be the case if the air passages were radially oriented). Rather, an angle 108 between a passage 82 and a tangential air path 110 originating at the outer end of the air passage 82 is approximately 75 degrees. In comparison, this same angle would be 90 degrees if air passage 82 were radially oriented. It has been found that an acute angle such as embodied by this 15 degree reduction in angle 108, greatly improves the volume and speed of air flow along the spiraling path, resulting in improving cooling of voice coil 56.

As shown in FIG. 15*a*, each of the air flows through air passages 82 of top pole half 42 enter throughbore 46 in a circumferential, counterclockwise direction along the outer wall of throughbore 46. Thus, each of the six air flows through the six air passages 82 are additive and each contributes to a same overall counterclockwise air flow within throughbore 46. That is, the six components of air flow do not clash or interfere with each other within throughbore 46. The upwardly spiraling inertia of the air flow through lower air passages 84, central bore 38, and upper air passages 82 carries over into throughbore 46 to cause the air to spiral upward through throughbore 46 and into cavity 72. The overall spiraling shape of the air flow provided by the non-radial orientation of air passages 82, 84 results in a smoother air path having turns that are not as acute or sharp as in the prior art. Thus, the air flow resistance within the speaker is reduced by the present invention, resulting in a faster and greater volume of air cooling former 58 and voice coil 56.

These air flow velocity vectors are reversed from the directions shown in FIGS. 13-15*a* when voice coil 56 is moving in a downward direction. That is, as air flows downward, out of the page of FIG. 15*a*, the air flows laterally outward through passages 82. Upon reaching the outer end of passages 82, the air flows clockwise (with respect to the viewpoint of FIG. 15*a*) around upper pole half 42, but with a downward bias as provided by the relatively large height of passages 82 as compared to their widths. The air flow continues spiraling downward until the air reaches bottom pole half 44, where the air continues to spiral clockwise around bottom pole half 44. The slanted orientation of air passages 84 provides a relatively smooth air path, and thereby facilitates the flow of the spiraling air into passages 84. Upon reaching bore 48, the air continues to flow clockwise with a downward bias, with each of the six tributaries of air flow from passages 84 contributing to the spiraling flow in bore 48. The air continues to spiral downwardly in bore 48 and throughbore 52 of backplate 34 before exiting speaker 20 via port 53.

As noted above, the speaker 20 exhibits a natural pumping action in that diaphragm 26 moves cooling air from outside of the speaker 20 in and out of the dust cap cavity 72 in response to axial excursion of voice coil 56. The configuration of pole piece 40 may cause the cooling air to be directed against voice coil 56 and/or the inner surface of former 58 in the course of the movement of voice coil 56 in and out of dust cap cavity 72 to thereby enhance the cooling effect.

In response to movement of voice coil 56 in a vertically upward direction, in the orientation depicted in FIG. 1, diaphragm 26 draws outside air into throughbore 52 through port 53. The cooling air enters a bore 48 of bottom pole half 44, and is then directed by air passages 84 into central bore 38. Once in central bore 38, the incoming air may then pass by both inner surface 60 of former 58 and voice coil 56. Specifically, the air may pass by voice coil 56 on the radially outer side of voice coil 56 and into a cavity 88 directly beneath spider 28. As voice coil 56 and former 58 move in an axially upward direction, spider 28 is pulled therewith in an upward direction, thereby expanding the volume of cavity 88 and drawing air therein from central bore 38.

From central bore 38, the incoming air is also drawn into dust cap cavity 72 along the radially inner side of former 58 as well as through top pole half 42. As shown in FIG. 1, a restricted air passageway 90 may be defined between an upper, radially outer edge of bottom pole half 44 and a bottom edge of former 58. Air passageway 90 may be relatively small compared to the unoccupied portion of central bore 38 (at least in some axial positions of former 58), and thus the air flow may increase in speed through air passageway 90 due to the Venturi effect. This increased air speed may enhance the cooling effect of the air flow on voice coil 56 and on former 58. Former 58 may function as a heat sink for voice coil 56, and thus cooling of former 58 may also effectively cool voice coil 56.

After passing through air passageway 90, the air may flow into dust cap cavity 72 through gap 86 between upper section 74 and former 58. However, a majority of the air may flow into dust cap cavity 72 through the less restricted path provided by air passages 82 of top pole half 42 which direct the air into throughbore 46 of top pole half 42.

As is evident from the combination of FIGS. 13-15*a*, the air flows in an overall spiral path from port 53 of back plate 34 to throughbore 46. The non-radial orientations of air passages 82, 84 contribute to the spiral shape of the path. It has been found that the spiral shape of the path provides reduced air flow resistance as compared with a path having tight, right angled, U-shaped turns (i.e., hairpin turns). Thus, the spiral-shaped air path provides increased air flow and a greater degree of cooling of voice coil 56.

In the embodiment shown in FIG. 1, the lengths of air passages 82 of top half 42 are oriented generally perpendicular to throughbore 46 and former 58. Similarly, the lengths of air passages 84 are oriented generally perpendicular to throughbore 52. However, air passages 82 and/or air passages 84 may be oriented at other angles so long as the cooling air is drawn past voice coil 56 and former 58.

Movement of voice coil 56 and diaphragm 26 in the opposite, vertically downward axial direction causes the air within dust cap cavity 72 to flow in the reverse direction along the same flow path. Thus, a heat exchange between the cooling air and voice coil 56 occurs in the course of movement of the air both into and out of dust cap cavity 72 during operation of speaker 20.

Each of passages 82 is defined by a wall 112 that is substantially tangent to a circumference of throughbore 46, and by an opposing parallel wall 114. An inner end 116 of each wall 112 is coincident with an inner end 118 of an adjacent, non-parallel wall 114. That is, walls 112, 114 meet at a point at the circumference of throughbore 46.

Figure 4:
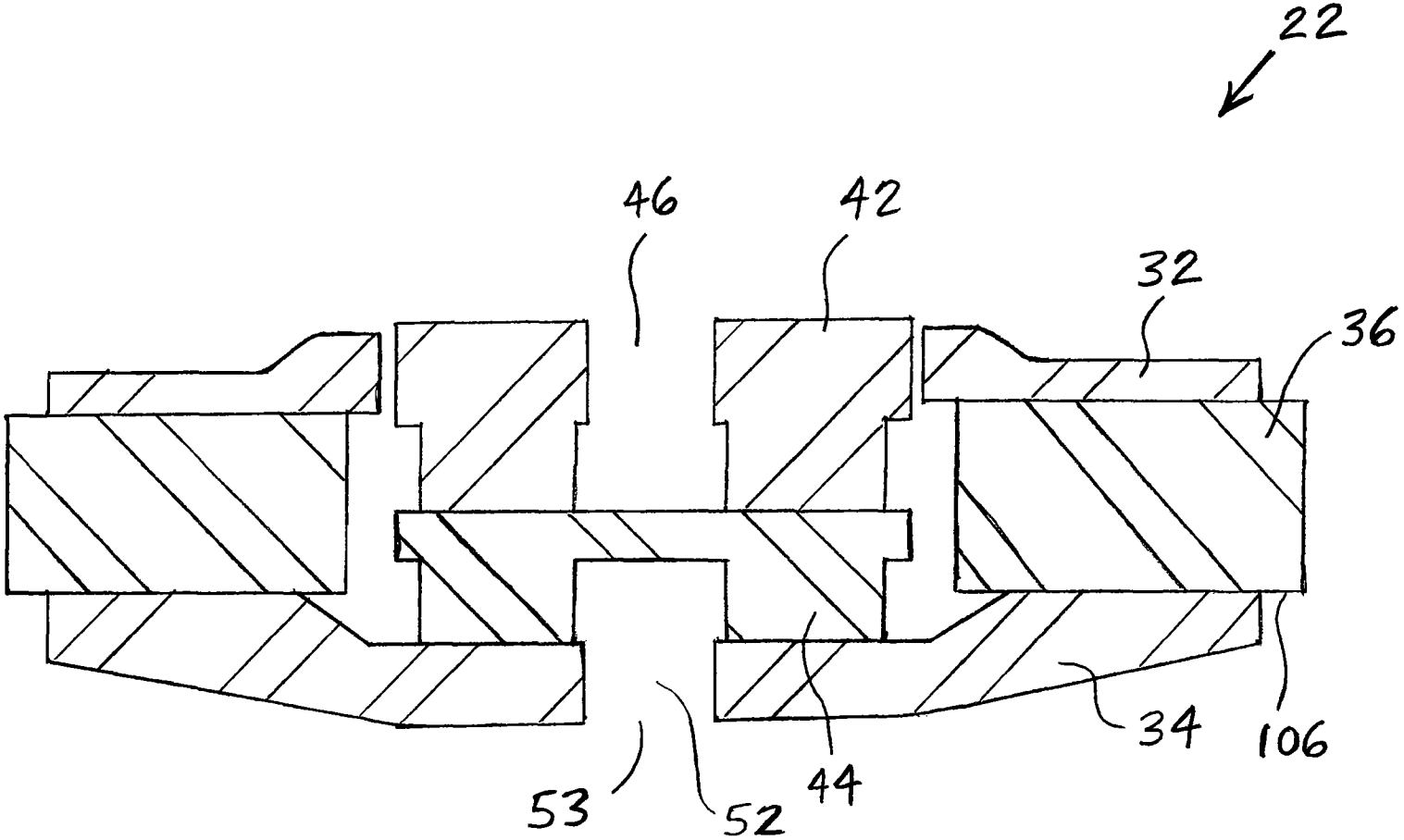
FIG. 4 is a cross-sectional view of the motor assembly of FIG. 3 along line 4-4.
Figure 15C:
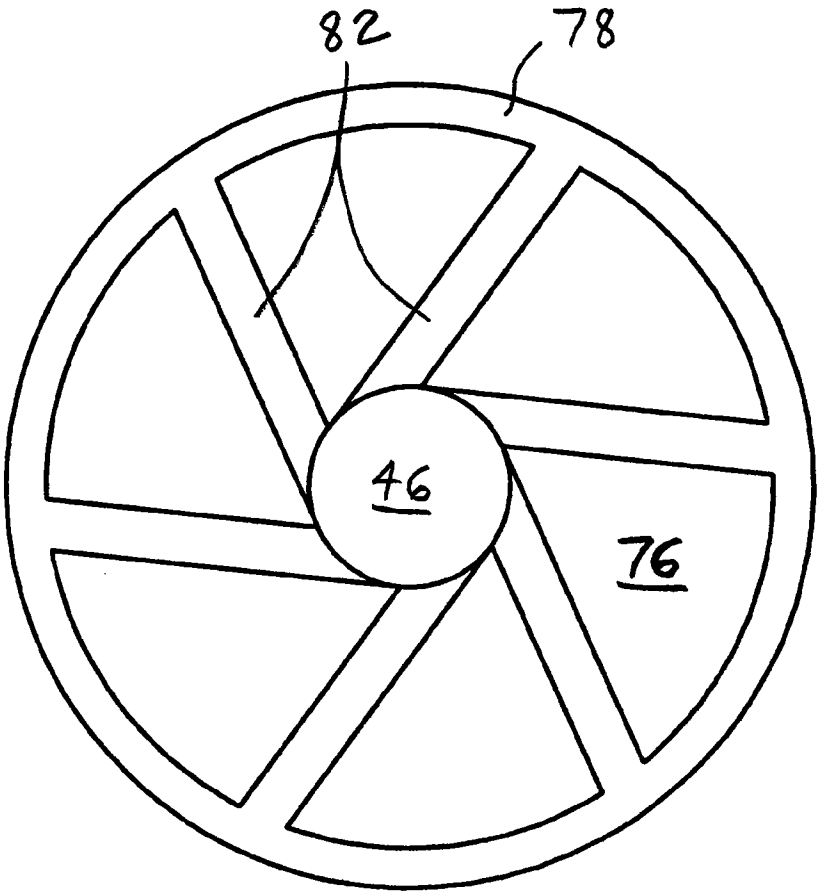
FIG. 15*c* is a top view of the lower section of the pole top half and the upper section of the pole bottom half of the motor assembly of FIG. 4.
Figure 15B:
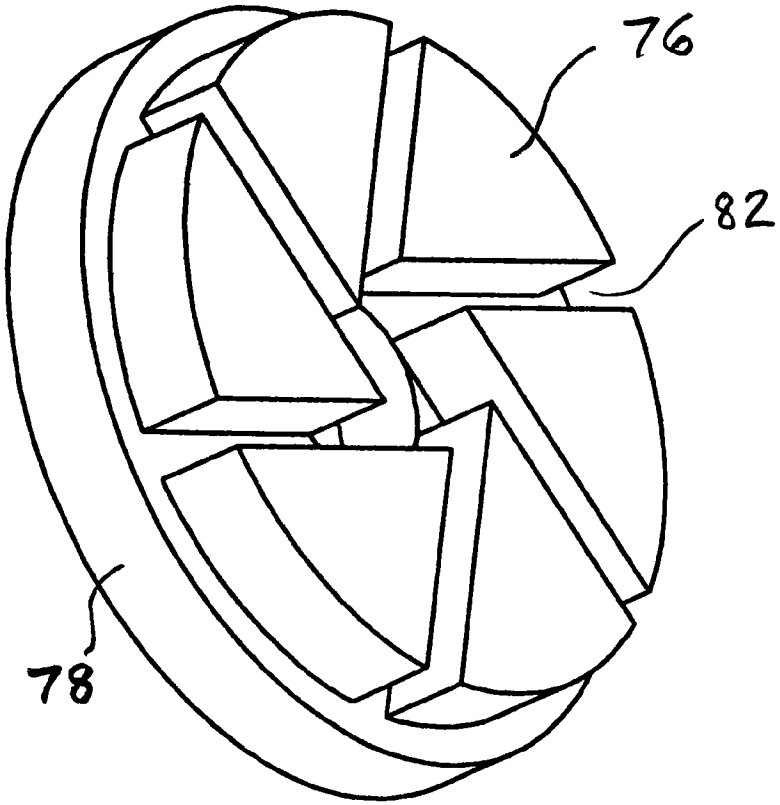
FIG. 15*b* is a perspective view of a lower section of the pole top half and an upper section of the pole bottom half of the motor assembly of FIG. 4.

FIG. 15*b* illustrates lower section 76 of pole top half 42 and upper section 78 of pole bottom half 44 of the motor assembly of FIG. 4 in a perspective view. FIG. 15*c* is a top view corresponding to FIG. 15*b*.

Figure 15E:
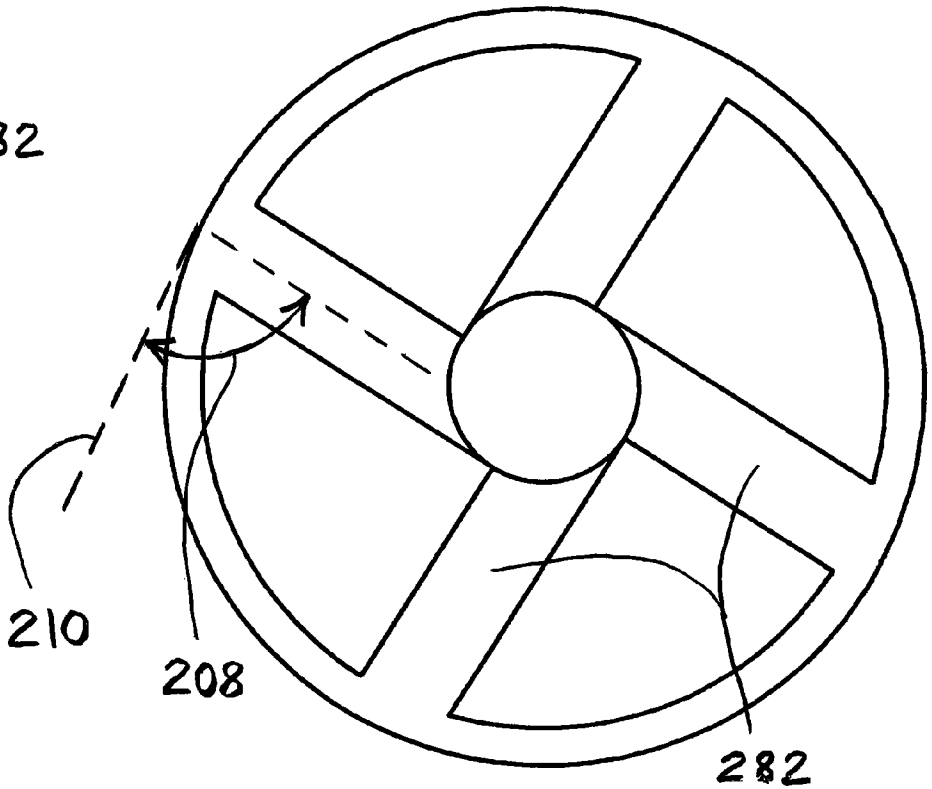
FIG. 15*e* is a top view of the lower section of the pole top half and the upper section of the pole bottom half of FIG. 15*d*.
Figure 15D:
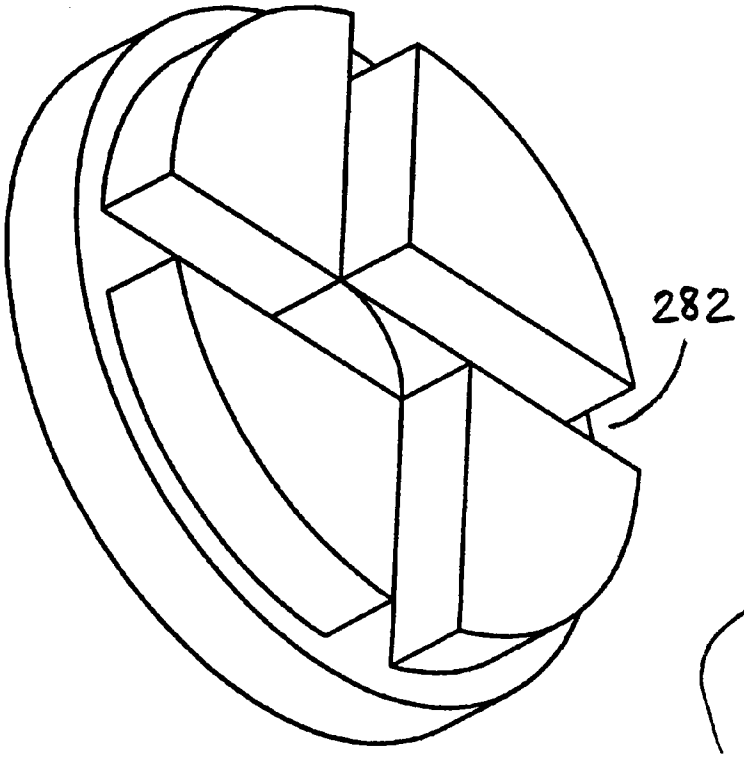
FIG. 15*d* is a perspective view of another embodiment of a lower section of the pole top half and an upper section of the pole bottom half of a motor assembly of the present invention.

FIG. 15*d* is a perspective view of another embodiment of a lower section of the pole top half and an upper section of the pole bottom half of a motor assembly of the present invention. FIG. 15*e* is a top view corresponding to FIG. 15*d*. In the embodiment of FIGS. 15*d-e*, there are only four passages 282 rather than the five passages 82 shown in FIGS. 15*a-c*. An angle 208 between a passage 282 and a tangential air path 210 originating at the outer end of the air passage 282 is approximately 80 degrees. In general, this angle between a passage and a tangential air path originating at the outer end of the air passage may depend upon the number of evenly spaced passages provided.

Figure 15G:
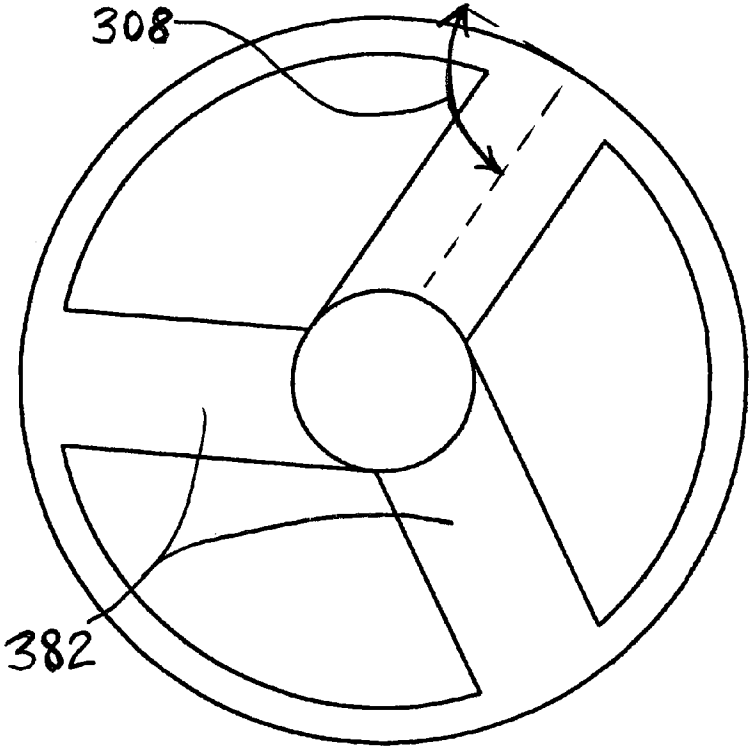
FIG. 15*g* is a top view of the lower section of the pole top half and the upper section of the pole bottom half of FIG. 15*f*.
Figure 15F:
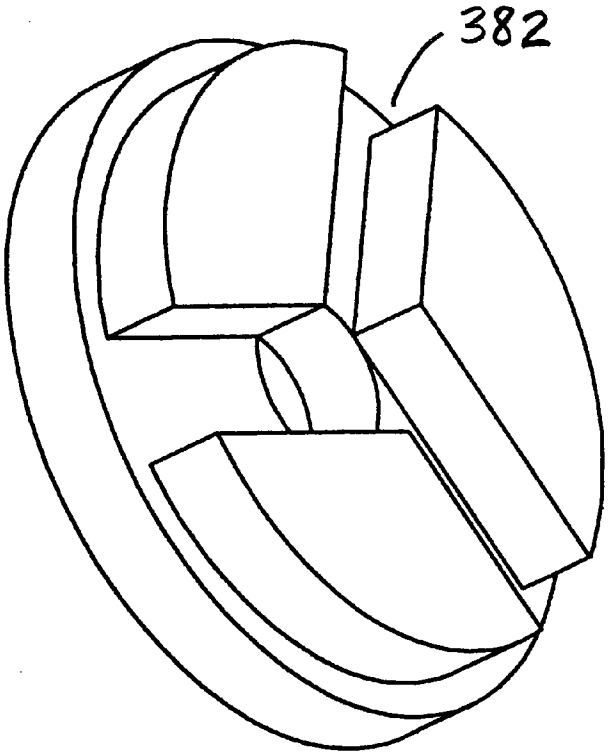
FIG. 15*f* is a perspective view of another embodiment of a lower section of the pole top half and an upper section of the pole bottom half of a motor assembly of the present invention.

FIG. 15*f* is a perspective view of another embodiment of a lower section of the pole top half and an upper section of the pole bottom half of a motor assembly of the present invention. FIG. 15*g* is a top view corresponding to FIG. 15*f*. In the embodiment of FIGS. 15*f-g*, there are only three passages 382 rather than the five passages 82 shown in FIGS. 15*a-c* and the four passages 282 shown in FIGS. 15*d-e*. An angle 308 between a passage 382 and a tangential air path 310 originating at the outer end of the air passage 382 is approximately 85 degrees.

Although these embodiments shown in FIGS. 15*a-g* include three, four or five air passages, the scope of the present invention may include any number of air passages. Each of these embodiments shown in FIGS. 15*a-g* provide a high percentage of open area at the circumference of the throughbore to thereby reduce air turbulence. The number of passages employed in a given application may depend upon a desired total cross-sectional area of the passages and upon magnetic considerations.

Figure 16:
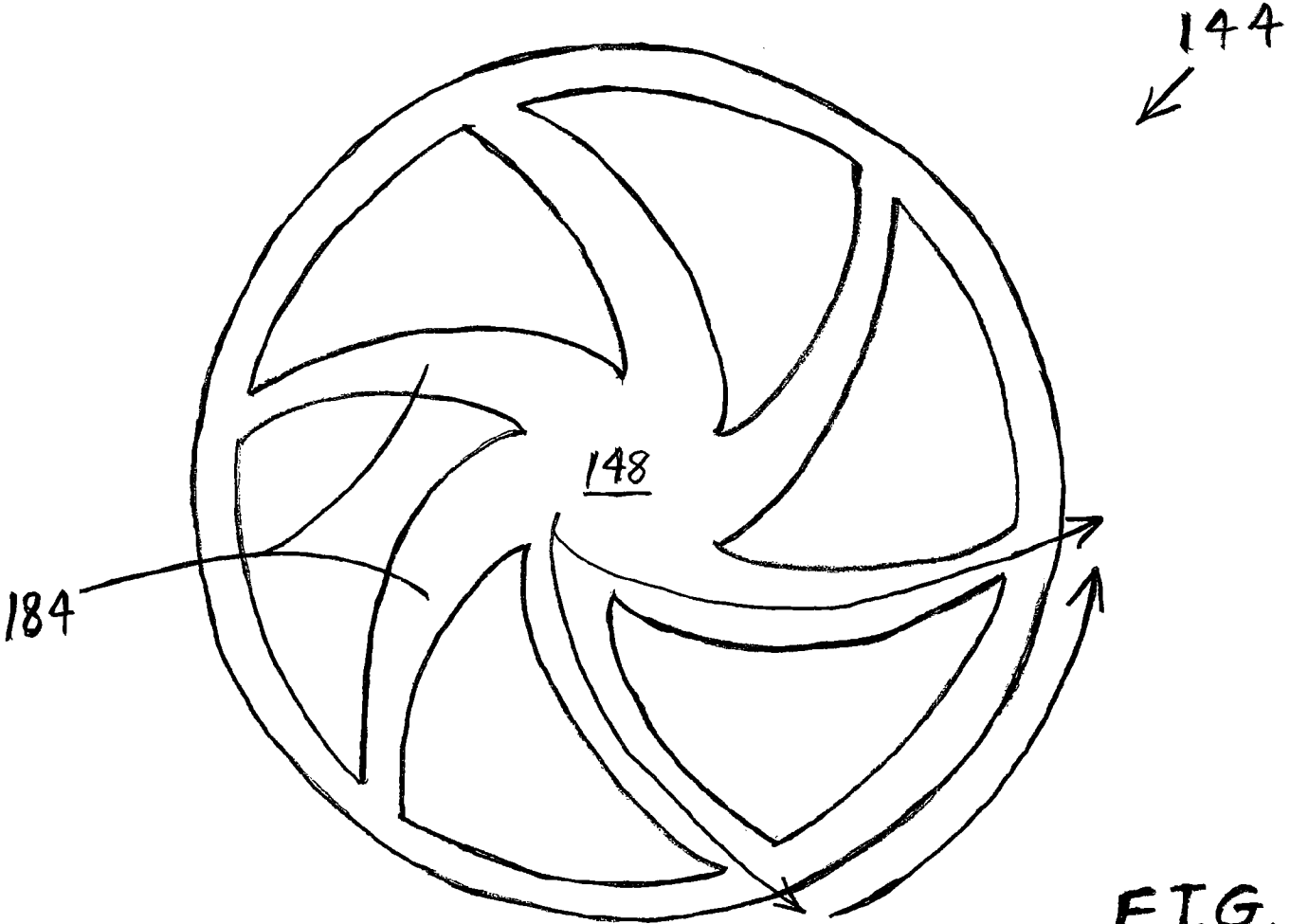
FIG. 16 is a top view of another embodiment of the pole bottom half of the motor assembly of FIG. 4 further illustrating the air flow of FIG. 13.

FIG. 16 illustrates another embodiment of a bottom pole half 144 that may be used in conjunction with the present invention. Air passages 184, like air passages 84, are non-radially oriented. Additionally, however, air passages 184 are arcuate rather than linear. That is, each of air passages 184 is curved from its inner end to its outer end in a direction that is counterclockwise in the bottom view of FIG. 16 with respect to a radial direction. Each of air passages 184 may have a constant radius of curvature throughout its length, or a majority of its length. Each of air passages 184 may be equally spaced apart with a same radius of curvature. Each of air passages 184 may have a constant width along its length, or along a majority of its length, although such is not the case in the embodiment shown in FIG. 16. The air flows through passages 184 in a same manner as with passages 84, resulting in a counterclockwise swirl around bottom pole half 144, similar to the counterclockwise swirl around bottom pole half 44.

Figure 17A:
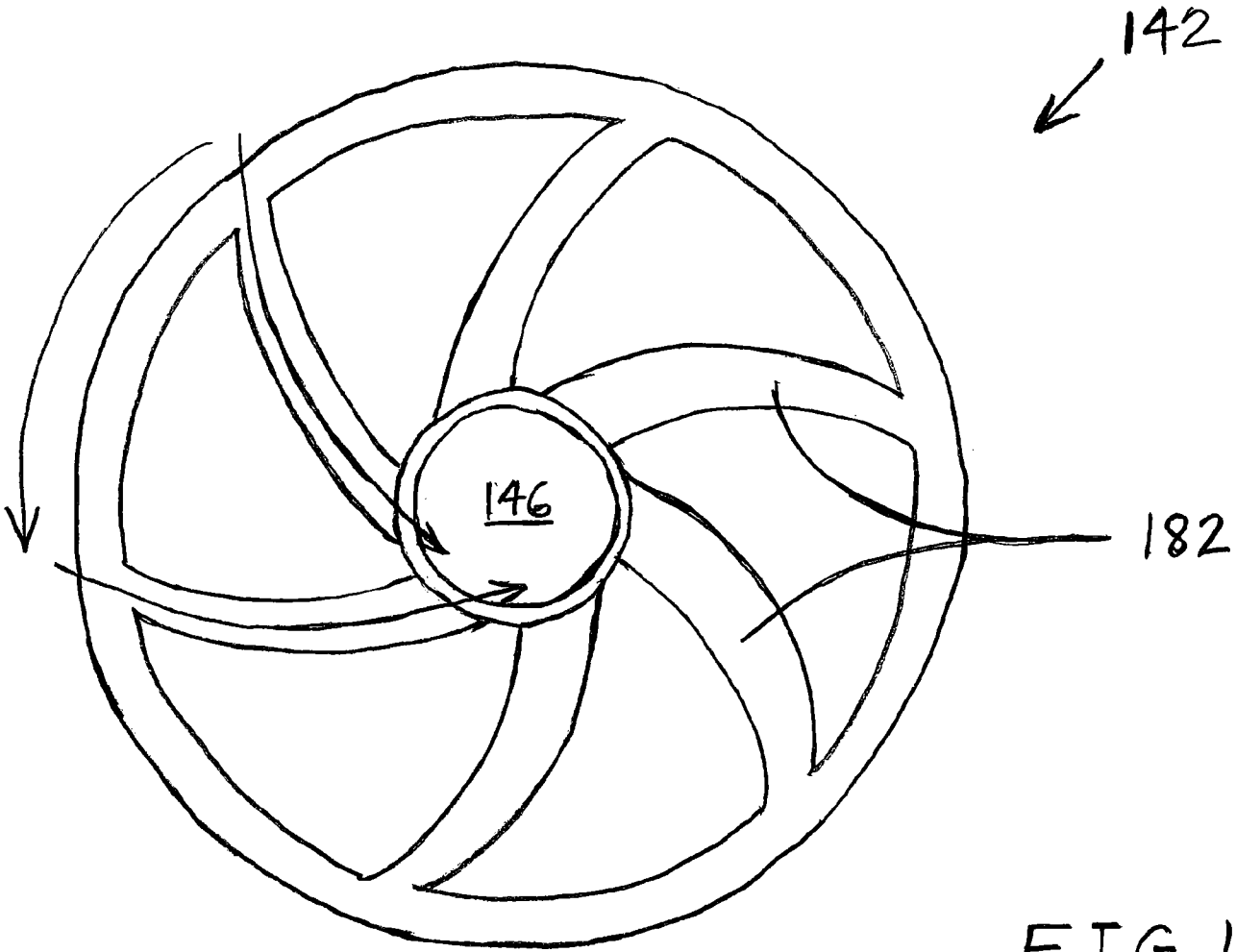
FIG. 17*a* is a top view of another embodiment of the pole top half of the motor assembly of FIG. 4 further illustrating the air flow of FIG. 13.

FIG. 17*a* illustrates another embodiment of a top pole half 142 that may be used in conjunction with the present invention. Air passages 182, like air passages 82, are non-radially oriented. Additionally, however, air passages 182 are arcuate rather than linear. That is, each of air passages 184 is curved from its inner end to its outer end in a direction that is clockwise in the bottom view of FIG. 17*a* with respect to a radial direction. Each of air passages 182 may have a constant radius of curvature throughout its length, or a majority of its length. Each of air passages 182 may be equally spaced apart with a same radius of curvature. Each of air passages 182 may have a constant width along its length, or along a majority of its length, although such is not the case in the embodiment shown in FIG. 17*a*. The air flows through passages 182 in a same manner as with passages 82, resulting in a clockwise swirl around bottom pole half 142, similar to the clockwise swirl around bottom pole half 42.

Arcuate air passages 182, 184 are curved in opposite directions with respect to the radial directions, as shown in FIGS. 16 and 17*a*. That is, air passages 184 are offset in a counterclockwise direction to thereby create a counterclockwise spiraling air flow in central bore 38 when air is moving into speaker 20. Air passages 182 are offset in a corresponding clockwise direction to thereby more efficiently capture the counterclockwise moving air in central bore 38. Conversely, when air is moving out of speaker 20, the clockwise offset of arcuate air passages 182 provide a clockwise rotation of air in central bore 38 (when viewed from the bottom, as in FIGS. 14-17*a*). The corresponding counterclockwise offset of air passages 184 provides increased efficiency in capturing the clockwise flow of air in central bore 38.

Each of air passages 184 is oriented tangentially relative to downwardly facing axial recess 148. Similarly, each of air passages 182 is oriented tangentially relative to upwardly facing axial recess 146. That is, an inner end of each of air passages 184 approximately defines a curve that is tangent to a circumference defined by downwardly facing axial recess 148, and an inner end of each of air passages 182 approximately defines a curve that is tangent to a circumference defined by upwardly facing axial recess 146.

Figure 17C:
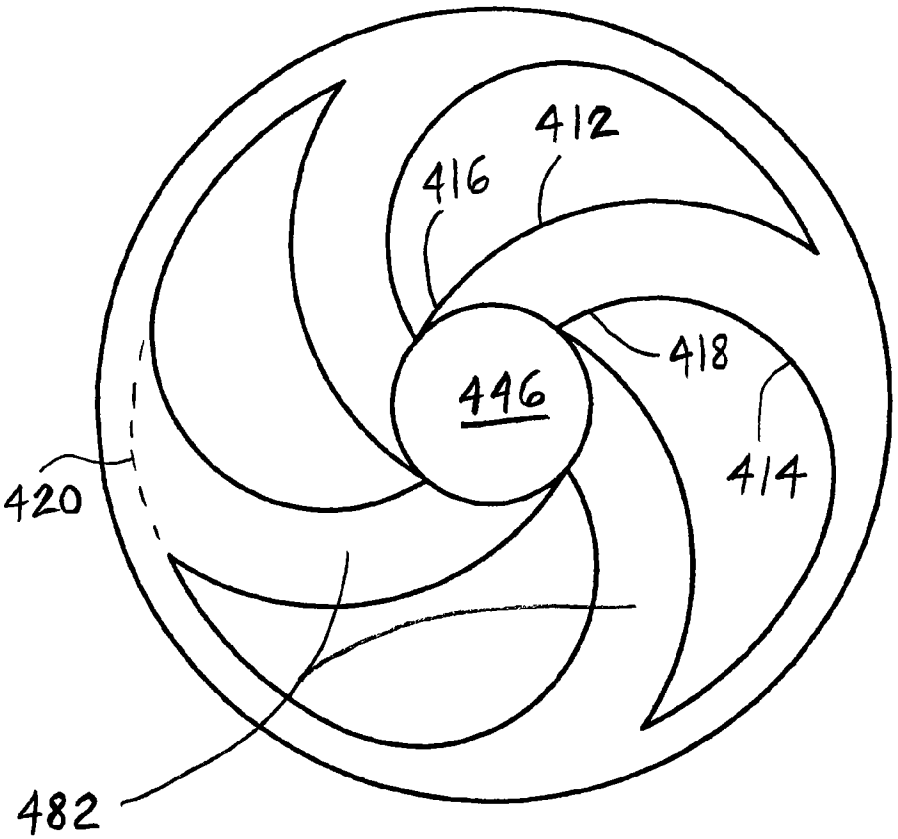
FIG. 17*c* is a top view of the lower section of the pole top half and the upper section of the pole bottom half of the embodiment of FIG. 17*b*.
Figure 17B:
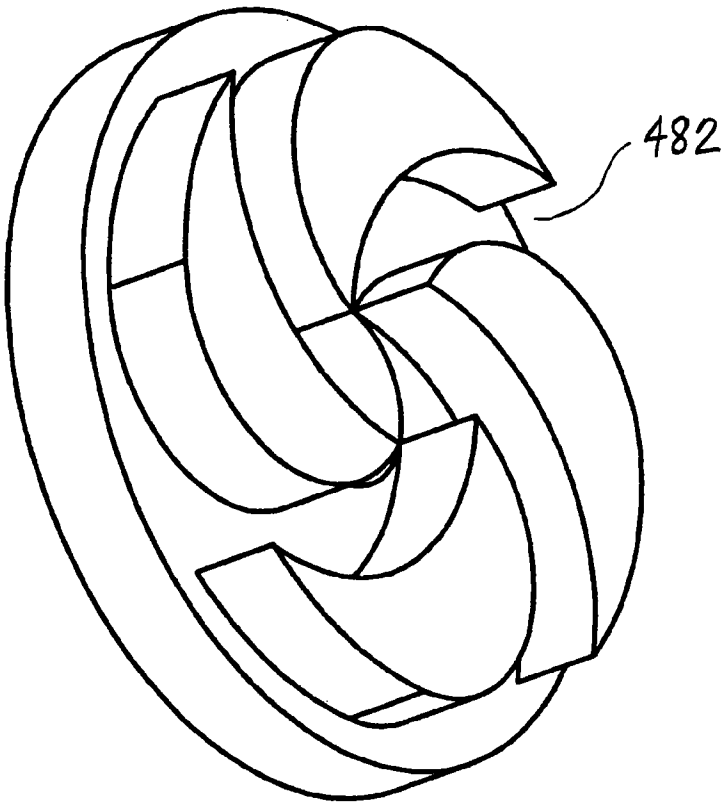
FIG. 17*b* is a perspective view of another embodiment of the lower section of the pole top half and an upper section of a motor assembly of the present invention.

FIG. 17*b* illustrates the lower section of a pole top half and an upper section of a pole bottom half of another embodiment of a motor assembly of the invention in a perspective view. FIG. 17*c* is a top view corresponding to FIG. 17*b*.

Each of air passages 482 is defined by a wall 412 that is substantially tangent to a circumference of throughbore 446, and by an opposing parallel wall 414. An inner end 416 of each wall 412 is coincident with an inner end 418 of an adjacent, non-parallel wall 414. That is, walls 412, 414 meet at a point at the circumference of throughbore 446. Each wall 414 is tangent to an outer circumference 420 of the lower section of the pole top half. This tangent relationship may reduce turbulence and improve the rotational energy in the air flow. The number of air passages employed in a given application may depend upon a desired total cross-sectional area of the passages and upon magnetic considerations.

Figure 18:
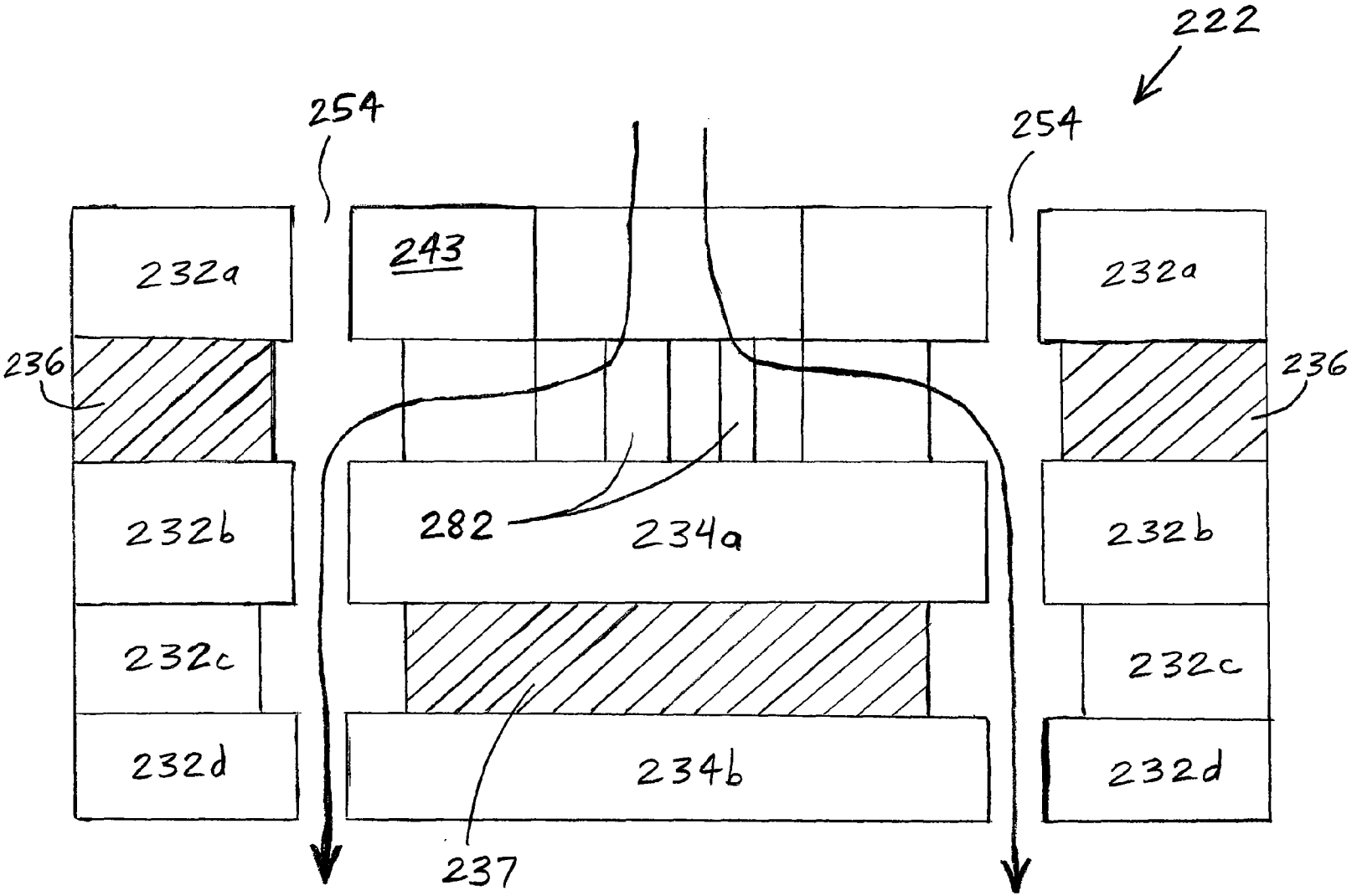
FIG. 18 is a cross-sectional view of another embodiment of a motor assembly of the present invention.

Illustrated in FIG. 18 is a cross-sectional view of another embodiment of a motor assembly 222 of the present invention including a pole 243, an annular magnet 236, a disc-shaped magnet 237, a plurality of annular steel rings 232*a*-*d*, and steel discs 234*a*-*b*. Magnets 236, 237 may have the same polarity. Pole 243 may have a structure that is similar to that of pole top half 42 or 142.

Air flow, as indicated by the arrows, may be driven by a spider (not shown), such as spider 28. The air flows in a generally lateral direction through air passages 282 in pole 243, and then flows downward through a cylindrical air gap 254. The air may flow in a direction opposite to that shown, depending on the current direction of movement of the spider.

Figure 19:
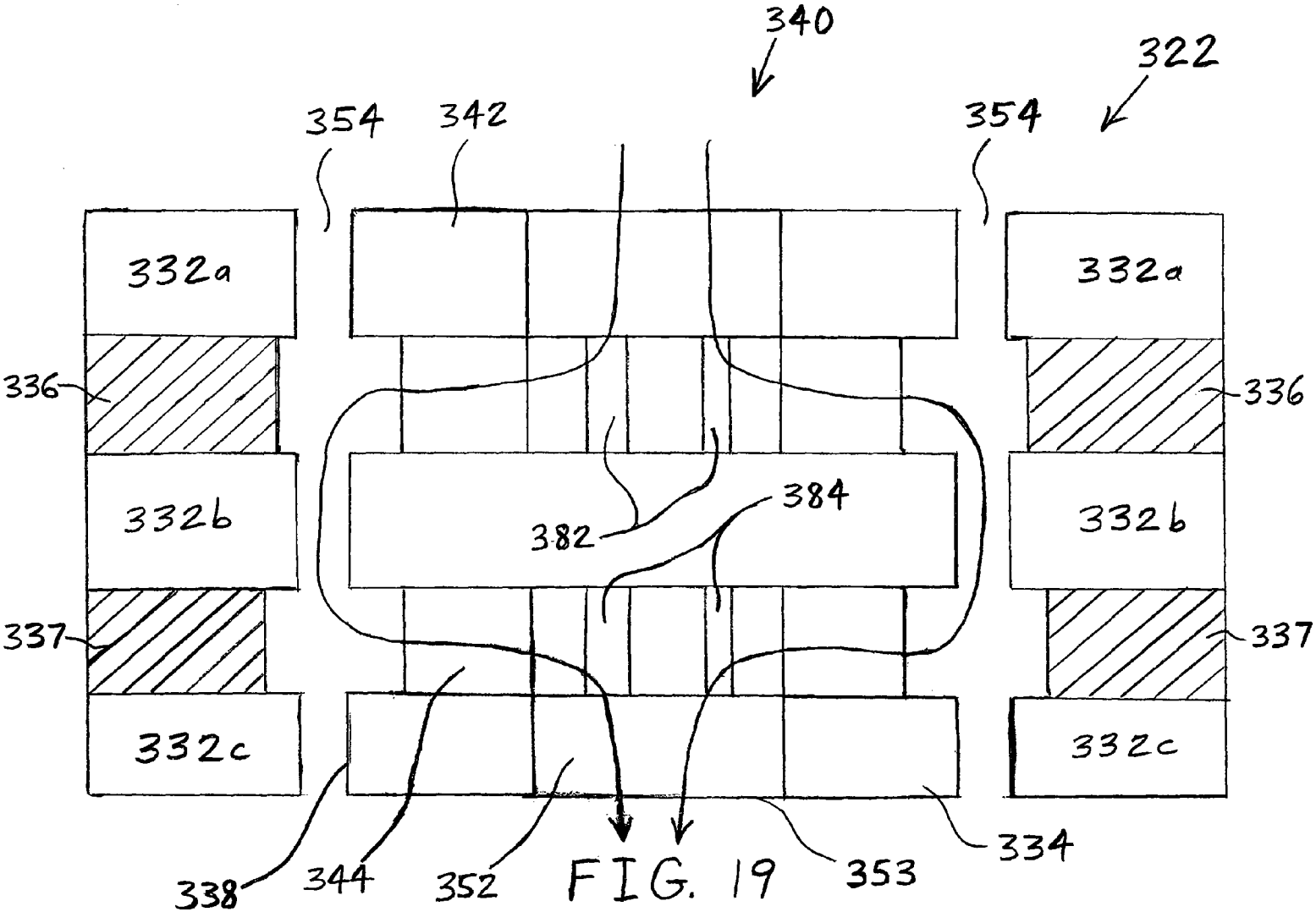
FIG. 19 is a cross-sectional view of yet another embodiment of a motor assembly of the present invention.

Illustrated in FIG. 19 is a cross-sectional view of yet another embodiment of a motor assembly 322 of the present invention including a pole 340 having a top pole half 342 and a bottom pole half 344. Motor assembly 322 also includes a top annular magnet 336, a bottom annular magnet 337, a plurality of annular steel rings 332*a*-*c*, and a donut-shaped back plate 334. Magnets 336, 337 may have opposite polarities such that magnets 336, 337 provide flux in a same direction through steel ring 332*b*. For example, magnet 336 may have its north pole on its top surface, while magnet 337 has its north pole on its bottom surface. Alternatively, magnet 336 may have its north pole on its bottom surface, while magnet 337 has its north pole on its top surface. Top pole half 342 may have a structure that is similar to that of top pole half 42 or 142. Bottom pole half 344 may have a structure that is similar to that of bottom pole half 44 or 144. Back plate 334 may have an annular outer surface 338 facing a cylindrical air gap 354.

Air flow, as indicated by the arrows, may be driven by the air trapped in the coil, or by a dust cap, such as dust cap 70. The air flows in a generally lateral direction through air passages 382 in top pole half 342, and then flows downward through air gap 354. The air then flows in an opposite generally lateral direction through air passages 384 in bottom pole half 344, through throughbore 352 in back plate 334, and out through port 353. The overall path of air flow may be spiraling, as is the case with the air flow within speaker 20 as described above. The air may flow in a direction opposite to that shown, depending on the current direction of movement of the spider and/or the former.

Figure 20:
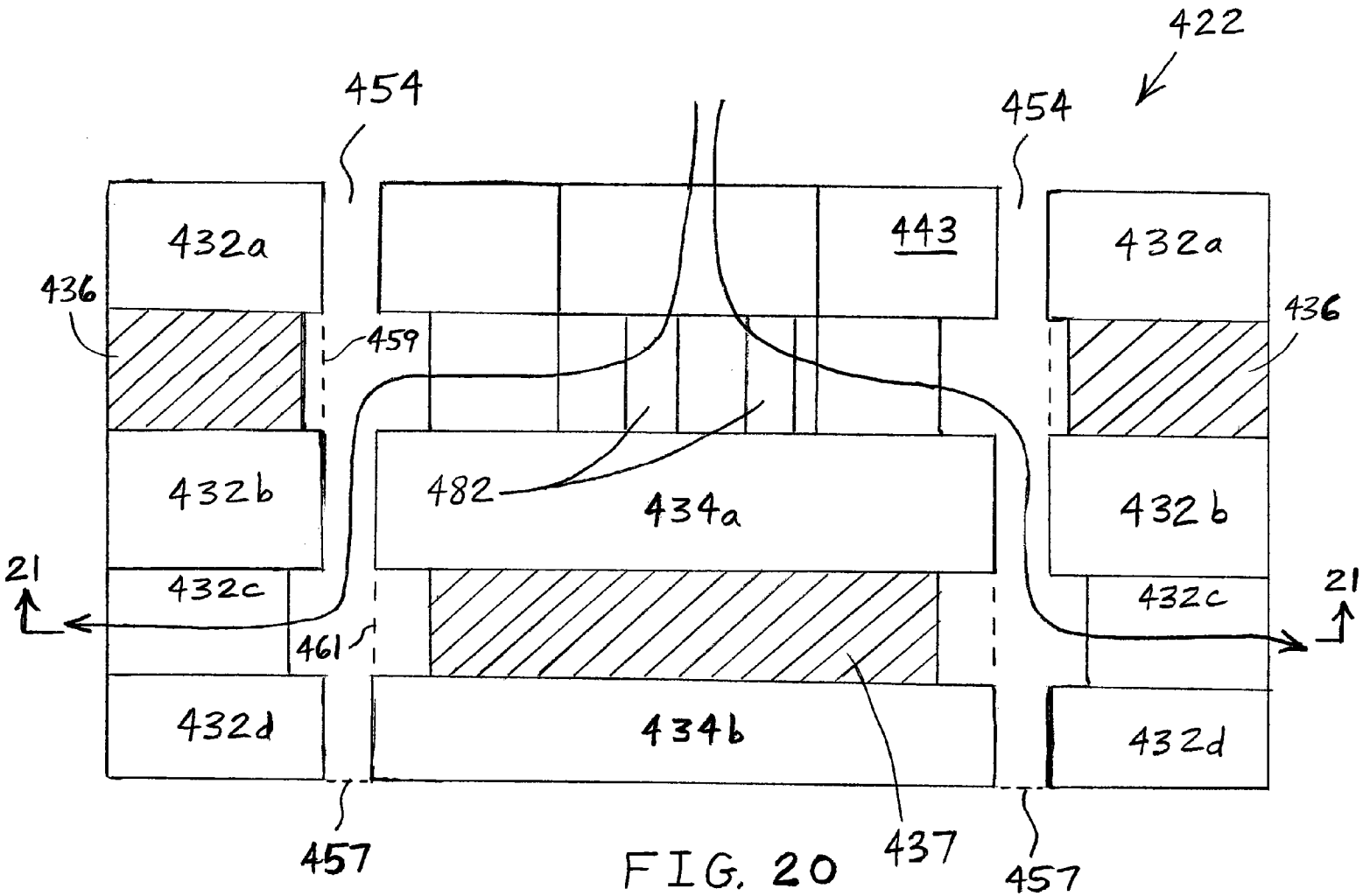
FIG. 20 is a cross-sectional view of a further embodiment of a motor assembly of the present invention.

Illustrated in FIG. 20 is a cross-sectional view of yet another embodiment of a motor assembly 422 of the present invention including a pole 443, an annular magnet 436, a disc-shaped magnet 437, a plurality of annular steel rings 432*a*-*d*, and steel discs 434*a*-*b*. Magnets 436, 437 may have the same polarity. Pole 443 may have a structure that is similar to that of pole top half 42 or 142.

Figure 21:
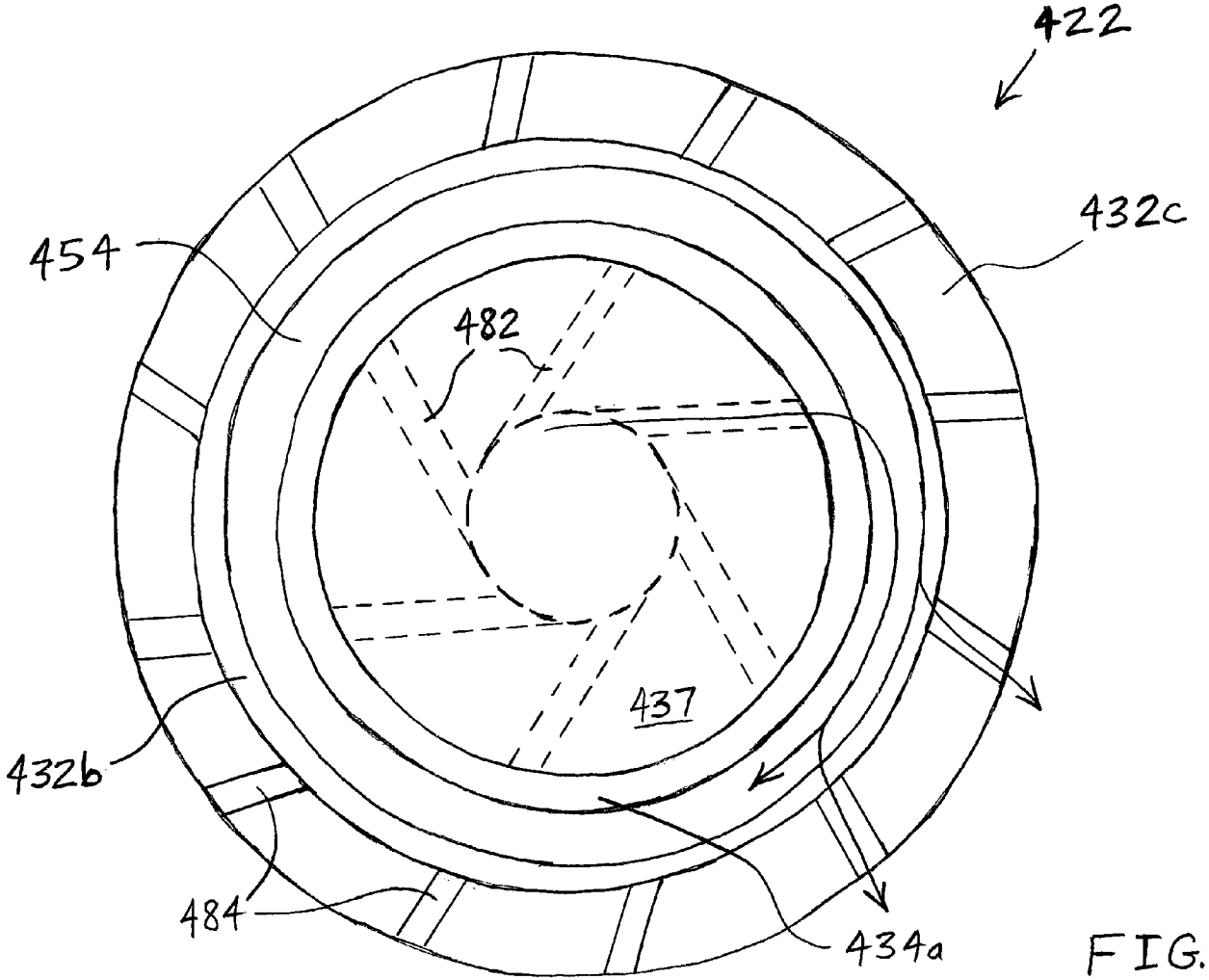
FIG. 21 is a cross-sectional view of the motor assembly of FIG. 20 along line 21-21.

Air flow, as indicated by the arrows, may be driven by the air trapped in the coil, or by a dust cap. The air flows in a generally lateral direction through air passages 482 in pole 443, and then flows downward within a cylindrical air gap 454. Annular steel ring 432*c* may have non-radially oriented air passages 484 (FIG. 21) that are offset from the radial direction in a same rotational direction as air passages 482. That is, air passages 484 are offset from the radial directions with respect to the airflow shown in FIG. 21 in a same clockwise direction as are air passages 482. Air passages 484 may have various cross-sectional shapes, such as rectangular, square, circular, or oval, for example. Air gap 454 may optionally be sealed at its bottom end, as schematically indicated at 457 by dashed lines. The air may flow in a direction opposite to that shown, depending on the current direction of movement of the spider.

As facilitated by the same clockwise offset of air passages 482, 484, the flowing air may follow a spiraling path through motor assembly 422. It is possible that at least some portions of the air flow complete at least one full rotation around air gap 454 in the descent from air passages 482 to air passages 484. These spiraling paths are advantageously relatively smooth and lacking in sharp or acute turns, thereby reducing air flow resistance, and increasing air flow speed and volume. Thus, the spiraling air paths result in greater cooling of the former and voice coil.

Optional annular aluminum rings 459, 461, the edges of which are indicated by dashed lines in FIG. 20, may be adhered to magnets 436, 437, respectively, in order to further smooth out the air flow path within air gap 454.

While this invention has been described as having an exemplary design, the present invention may be further modified within the spirit and scope of this disclosure. This application is therefore intended to cover any variations, uses, or adaptations of the invention using its general principles.

What is claimed is:

1. A low frequency transducer arrangement comprising:
at least one substantially annular magnet;
a voice coil disposed within and concentric with the magnet;
a pole disposed within and concentric with the voice coil, an air gap being defined between the magnet and the pole, the pole including:
a bottom half having a downwardly facing axial recess, a plurality of first air passages extending laterally from the axial recess and fluidly interconnecting the recess and the air gap; and
a top half having an upwardly facing axial recess, a plurality of second air passages extending laterally from the upwardly facing axial recess and fluidly interconnecting the upwardly facing recess and the air gap, wherein the first air passages and/or the second air passages are non-radially oriented.

2. The arrangement of claim 1 wherein at least one of the first air passages and/or second air passages is arcuate.

3. The arrangement of claim 1 wherein the voice coil is moveable within the air gap in an axial direction.

4. The arrangement of claim 1 wherein the first air passages are substantially evenly spaced, and the second air passages are substantially evenly spaced.

5. The arrangement of claim 1 wherein each of the first air passages is offset from the radial direction in one of a clockwise direction and a counterclockwise direction, and each of the second air passages is offset from the radial direction in an other of a clockwise direction and a counterclockwise direction.

6. The arrangement of claim 1 wherein each of the first air passages is oriented tangentially relative to the downwardly facing axial recess, and each of the second air passages is oriented tangentially relative to the upwardly facing axial recess.

7. The arrangement of claim 1 further comprising a back plate supporting both the bottom half of the pole and the magnet, the back plate including:
an axial throughbore fluidly interconnecting the downwardly facing axial recess with ambient air; and
a ramped surface disposed at a same vertical level as the first air passages.

8. A low frequency transducer arrangement comprising:
an annular magnet;
a voice coil disposed within and concentric with the magnet;
a pole disposed within and concentric with the voice coil, a cylindrical air gap being defined between the magnet and the pole, the pole being at a substantially same vertical level as the magnet, the pole including an upwardly facing axial recess, a plurality of non-radially oriented first air passages extending laterally from the upwardly facing axial recess and fluidly interconnecting the upwardly facing recess and the air gap; and
an annular steel ring disposed below and concentric with the magnet, the annular steel ring at least partially defining an outer boundary of the air gap, the steel ring including a plurality of non-radially oriented second air passages extending laterally from the air gap and fluidly interconnecting the air gap and ambient air.

9. The arrangement of claim 8 wherein the first air passages and/or the second air passages are arcuate.

10. The arrangement of claim 8 wherein the first air passages are substantially evenly spaced, and the second air passages are substantially evenly spaced.

11. The arrangement of claim 8 wherein each of the first air passages and second air passages is offset from the radial direction in a same one of a clockwise direction and a counterclockwise direction.

12. The arrangement of claim 8 wherein each of the first air passages is oriented tangentially relative to the downwardly facing axial recess.

13. A low frequency transducer arrangement comprising:
two substantially annular and concentric magnets;
a voice coil disposed within and concentric with at least an upper one of the magnets;
a pole disposed within and concentric with the voice coil, an air gap being defined between the magnets and the pole, the pole including:
a bottom half having a downwardly facing axial recess, a plurality of first air passages extending laterally from the axial recess and fluidly interconnecting the recess and the air gap, the bottom half being at a substantially same vertical level as a lower one of the magnets; and
a top half having an upwardly facing axial recess, a plurality of second air passages extending laterally from the upwardly facing axial recess and fluidly interconnecting the upwardly facing recess and the air gap, wherein the first air passages and/or the second air passages are non-radially oriented, the top half being at a substantially same vertical level as the upper one of the magnets.

14. The arrangement of claim 13 wherein a magnetic polarity of a bottom surface of the upper magnet matches a magnetic polarity of a top surface of the lower magnet.

15. The arrangement of claim 13 wherein at least one of the first air passages and/or second air passages is arcuate.

16. The arrangement of claim 13 wherein the voice coil is moveable within the air gap in an axial direction.

17. The arrangement of claim 13 wherein the first air passages are substantially evenly spaced, and the second air passages are substantially evenly spaced.

18. The arrangement of claim 13 wherein each of the first air passages is offset from the radial direction in one of a clockwise direction and a counterclockwise direction, and each of the second air passages is offset from the radial direction in an other of a clockwise direction and a counterclockwise direction.

19. The arrangement of claim 13 wherein each of the first air passages is oriented tangentially relative to the downwardly facing axial recess, and each of the second air passages is oriented tangentially relative to the upwardly facing axial recess.

* * * * *